US009322225B2

(12) United States Patent
Møgedal et al.

(10) Patent No.: US 9,322,225 B2
(45) Date of Patent: Apr. 26, 2016

(54) WEAK LINK FOR A RISER SYSTEM

(71) Applicant: Aker Subsea AS, Lysaker (NO)

(72) Inventors: Knut Møgedal, Asker (NO); Kristian Guttulsrud, Asker (NO); David Brown, Oslo (NO); Jonas Åkerlund, Jar (NO)

(73) Assignee: AKer Subsea AS, Lysaker (NO)

( * ) Notice: Subject to any disclaimer, the term of this patent is extended or adjusted under 35 U.S.C. 154(b) by 0 days.

(21) Appl. No.: 14/441,859

(22) PCT Filed: Nov. 19, 2013

(86) PCT No.: PCT/NO2013/050202
§ 371 (c)(1),
(2) Date: May 11, 2015

(87) PCT Pub. No.: WO2014/081312
PCT Pub. Date: May 30, 2014

(65) Prior Publication Data

US 2015/0285010 A1 Oct. 8, 2015

(30) Foreign Application Priority Data

Nov. 20, 2012 (NO) ..... 20121375

(51) Int. Cl.

| | |
|---|---|
| ***F16K 17/40*** | (2006.01) |
| ***E21B 7/12*** | (2006.01) |
| ***E21B 43/00*** | (2006.01) |
| ***E21B 17/01*** | (2006.01) |
| ***E21B 17/06*** | (2006.01) |

(52) U.S. Cl.
CPC ..... *E21B 17/06* (2013.01); *E21B 17/01* (2013.01)

(58) Field of Classification Search
USPC ..... 166/359
See application file for complete search history.

(56) References Cited

U.S. PATENT DOCUMENTS

| | | | | |
|---|---|---|---|---|
| 3,488,031 | A | 1/1970 | Bezner et al. | |
| 4,361,165 | A | 11/1982 | Flory | |
| 4,880,257 | A * | 11/1989 | Holbert, Jr. | E21B 17/06 285/2 |
| 5,382,056 | A | 1/1995 | Milberger | |
| 8,181,704 | B2 * | 5/2012 | Fenton | E21B 17/06 166/338 |
| 8,555,981 | B2 * | 10/2013 | Edwards | E21B 17/085 166/365 |
| 2011/0127041 | A1 | 6/2011 | Edwards et al. | |
| 2012/0205118 | A1 | 8/2012 | Edwards | |

OTHER PUBLICATIONS

Eriksson, Magnus, "International Search Report" prepared for PCT/NO2013/050202, as mailed Feb. 14, 2014, three pages.

* cited by examiner

*Primary Examiner* — Matthew R Buck
*Assistant Examiner* — Douglas S Wood
(74) *Attorney, Agent, or Firm* — Winstead PC

(57) ABSTRACT

A weak link (17, 43) for a riser system comprising a pin (2, 25) and a box (1, 24), bolts (11, 34) for releasably connecting the pin (2, 25) and the box (1, 24), the bolts being designed to break at a predefined tension. The link further comprising a pressure balancing mechanism for balancing axial forces acting on the bolts (11, 34) due to end cap effect. The weak link also comprises a strong mode mechanism and a dampening mechanism.

23 Claims, 20 Drawing Sheets

WEAK LINK FOR A RISER SYSTEM

FIELD OF THE INVENTION

The present invention relates in general to a safety joint for a riser system, commonly known as weak link in hydrocarbon exploration terminology. A riser can be disconnected by such link in the event of any unforeseen emergency circumstances such as extreme weather, power failure on the vessel, failure of anchoring or positioning system and so on.

Particularly, the present invention relates to a weak link for a riser system, which has a pressure balancing mechanism for balancing any end cap effect on the release bolts of the weak link. This pressure balancing mechanism preferably operates in conjunction with a damping mechanism, for ensuring that separation is along such weak link takes place in a controlled manner, limiting and dispersing the extreme forces following release.

The present invention also relates to a weak link for a riser system which has a strong mode mechanism for increasing the gripping force between its two releasably joined component portions as and when required.

More particularly, the present invention relates to a weak link for a riser system according to the preamble of the independent claim 1.

TECHNICAL BACKGROUND OF THE INVENTION

It is known that during completion and workover operations within the area of subsea operation, weak links are utilized.

The function of the weak link is to provide a given and controlled method of ultimate separation of the riser, if all other known methods have failed, and the operator is in a worst case mode. Such a mode may arise due to extreme weather, failure of anchoring or positioning system, black-out (power failure) on the vessel, or by other unforeseen means.

In such a worst case scenario it is vital that the vessel is able to passively disconnect from the wellhead and infrastructure on the sea bed, in order to remove the vessel from the conduit to the reservoir and to avoid uncontrolled breaking of the riser and subsequent possible blow-out. This is also required to ensure safety to the personnel onboard. Such a passive disconnection is achieved by use of a weak link.

The failure of the weak link (i.e. the disconnection caused by a weak link in its normal mode of operation) can be attributed to several prime failure modes, and in these can be further related to the operational window and physical position of the vessel.

A heave compensation system for a riser system compensates for variations in the vessel's vertical position in relation to the seabed and inherent upward pull, provided by the vessel. It ensures that buckling/tear-off of the riser system is avoided. If this heave compensation system fails, a failure mode known as 'compensator lock up' takes place. This then results in application of tension or compression on the riser system, due to changing vertical position of the vessel, caused by wave motion.

Such failure causes buckling or over-pull and unless the over-pull is limited by a weak link then the operator runs the risk of damage to the subsea systems, including the wellhead, and ultimately risks substantial environmental pollution due to leakage of hydrocarbons, and in worst case a blow-out. The weak-link thus has to fail in a mode whereby the vessel is "on station" (in the correct position) but has a compensator that has locked up, resulting in the vessel applying its own heave (vertical motion due to wave patterns) directly to the riser. Ideally a weak link should protect for such a case.

If the system used to maintain on-station position, either via anchoring or dynamical positioning using thrusters, should fail then a situation known as drift-off or drive-off will occur. This results in the vessel rapidly leaving the green (safe) operation window and entering the yellow (unsafe) and red (danger) zones. These are determined by actual vessel position, relative to a nominal purely vertical riser system.

In case of drift-off, the weak link should be able to fail ultimately, with a permanent break and separation of upper and lower riser sections. The most important aspect is to completely and immediately passively disconnect the vessel from the subsea infrastructure, and hence avoid any damage to the wellhead and/or vessel and personnel.

Conventional weak links are constructed most often by the use of two flanged sections of riser that are bolted together at the flanges using tension bolts, whereby the bolts are designed to fail at a given load.

The riser itself may be in a depressurized state (atmospheric pressure) during the course of operation, or it may be filled with oil and/or gas at pressure. Due to the end-cap effect of the riser system, the pressure present in the riser will exert a tension force in the riser equal to the pressure multiplied by the cross sectional area of the pressurized medium. This tension force acts at every cross section of the riser, hence also acts at the tension bolts. Due to varying pressure (from atmospheric during initial installation) and through to full bore pressure, the tension bolts will be subjected to varying pretensions in the riser.

This results in the weak link being susceptible to failure at varying mechanical tensions (T fail=T bolts−T end cap). Given the constant value of the bolt tension failure load, and the variation of pressure, the operator will be depending on a weak link with varying and uncontrollable tension limits. This in practice reduces and affects the safe mode of operation.

Hence the tension load (end cap) due to variations of bore pressure has to be balanced; so called "pressure balance" whilst not compromising the normal operation of disconnection/opening of the weak link.

US patent publication number 2011/0127041A1 attempts to teach such pressure balance by providing a riser weak link having an upper housing and a lower housing which are releasably attached by studs. The studs are designed to break at predefined load. There is also a pressure application device which provides a coupling force on the upper housing to counter balance the separation force applied by well pressure. This ensures that the only separation force acting on the top portion of a riser system attached to the upper housing, is the tension applied by the surface vessel.

However, the prior art acknowledged in the preceding paragraph, has a major draw back. On release of the studs at predefined tension load, the upper housing and lower housing are likely to separate with a sudden snap or jerk. Such recoiling of upper housing and lower housing and the corresponding riser portions attached to each, leave potentialities of damage to sub-sea infrastructure and equipment and to personnel on the surface, wide open.

Apart from the disadvantage in the preceding paragraph, the prior art does not teach specifically and explicitly the adaptability of the weak link to effectively function when the riser system is in operation in subsea condition (i.e. weak link operating in weak mode) and also when the riser system is lowered and retrieved; i.e. weak link operating in strong mode when the gripping force between the two principal releasably connected components of the weak link, need to be strengthened.

Accordingly, there is a long felt need for a weak link for riser systems which has a pressure balancing mechanism which can effectively work with a damping mechanism, so that the upper riser portion and the lower riser portion on disconnection by release of the connection tool such as studs or release bolts, are separated in a controlled manner, limiting substantially any sort of recoiling.

There is also a need for a weak link for riser systems which has a simple mechanism for effectively functioning under varying conditions, when the riser system is in operation in subsea condition and also when the riser system is lowered and retrieved. It is common to use a riser as a lowering means for a valve tree (XMT), by attaching the XMT below the emergency disconnect package (EDP) & lower riser package (LRP) at the lower end of the riser. This is a very heavy assembly, and the inclusion of a conventional weak link poses potentially disastrous overloading risks, particularly in poor weather. Alternatively, the operational window is very narrow.

The present invention meets the above mentioned needs and other associated needs by providing a weak link for riser systems having a pressure balancing mechanism which can effectively function in association with a damping mechanism for controlled and smooth separation of the two main releasably joined components of the weak link, each having portions of risers, connected at lower end and top end respectively. The weak link according to the present invention can also effectively function in both weak mode and strong mode as explained before, in a very simple manner.

OBJECTS OF THE INVENTION

It is one of the principal objects of the present invention to provide a weak link for a riser system which has a pressure balancing mechanism for balancing the end cap effect, which pressure balancing mechanism effectively functions with a damping mechanism for controlled separation of a top portion of a riser system, from its bottom part.

It is another object of the present invention to provide a weak link for a riser system which is equipped to effectively function under varying conditions, when the riser system is in operation in subsea condition and also when the riser system is lowered and retrieved.

It is a further object of the present invention to provide a weak link for a riser system which has a simple construction and works on a simple principle for achieving the objects as mentioned above.

All through the specification including the claims, the words "box", "pin", "weak link", "riser system", "damping", "anti recoil", "weak mode", "strong mode", "safety joint" are to be interpreted in the broadest sense of the respective terms and includes all similar items in the field known by other terms, as may be clear to persons skilled in the art. Restriction or limitation, if any, referred to in the specification, is solely by way of example and for explaining the present invention. Further, it is hereby clarified that the term "riser system" should be construed in its broadest sense as applicable in subsea operations.

SUMMARY OF THE INVENTION

According to a primary aspect of the present invention a weak link for a riser system is provided, comprising a first member and a second member, a connection means for releasably connecting said first member and said second member, said connection means being designed to break at a predefined tension wherein a pressure balancing mechanism is provided, for balancing axial forces acting on said connection means due to end cap effect of said riser system. This will substantially cancel out end cap effects and provide greater predictability for the break tension of the connection means, e.g. bolts.

In a preferred embodiment the first member is a pin and said second member is a box, said pin and box being releasably interconnected by release bolts. This provides a simple construction based on per se known principles of a telescopic joint.

In a further preferred embodiment the pressure balancing mechanism has a first pressure balance piston for transferring pressure load to said box and a second pressure balance piston for transferring pressure load to said pin, both pistons being located in an annulus between the pin and the box, said annulus being in pressure communication with a bore of the pin, said pressure loads acting in opposite directions on the pistons. This provides a reliable means for ensuring that the pressure in the balancing mechanism is substantially corresponding to the pressure in the riser bore.

In a further preferred embodiment a radially moveable load transfer segment is located in connection with the first pressure balance piston for transferring the load from the first pressure balance piston to the box and the second pressure balance piston connected to the pin, preferably by a threaded connection, for transferring the load from the second pressure balance piston to the pin. This will ensure a reliable load transfer from the pressure balancing mechanism to the pin and box.

In a further preferred embodiment it comprises a stinger that is fixed at a first end to the box and has a second end extending into the bore of the pin, said stinger providing a narrow annulus with the pin, which in turn provides communication between the bore of the pin and an annulus between the pin and the box. This ensures that the riser bore maintains its integrity as long as possible as the weak link strokes and that a seal between the pin (2) and the box (1) is maintained during the separation stroke.

In an even further preferred embodiment the box comprises an aperture providing communication between the surrounding seawater and a void on the opposite side of the second pressure balance piston from the annulus. This will ensure that the pressure balance mechanism maintains the same pressure conditions when the weak link strokes out.

In an even further preferred embodiment the pin comprises apertures providing communication between the bore of the pin and the annulus. This ensures consistent pressure in the balancing mechanism with the bore of the riser.

In an even further preferred embodiment the box comprises an aperture extending to the surrounding seawater, which aperture is adapted to communicate with at least one of the apertures in the pin when the pin has moved partially out of the box, so as to bleed off pressure within the riser to the surrounding seawater. This will substantially reduce or eliminate the jet effect that would tend to push the riser upward when separation occurs.

In a further preferred embodiment the weak link comprises a damping mechanism for damping any sudden recoiling effect between said first member and said second member during their separation by breaking of said connection means. This substantially reduces the recoiling effect due to separation.

In a preferred embodiment the damping mechanism comprises one or more cylinders and piston arrangements, the damping mechanism being connected to the box by one of the cylinder or the piston arrangement and the other of the cylinder and the piston arrangement being connected to the pin. This will provide an effective dampening mechanism that can be dimensioned according to the requirements independent of the balancing mechanism.

In a further preferred embodiment the dampers are filled with seawater when submerged. This ensures a pollution free system with little complexity.

In a further preferred embodiment the damper has at least one small aperture arranged to slowly expel fluid contained inside the damper through said aperture, for damped separation of said box and said pin. This ensures a controlled dampening with simple and reliable means.

In an alternative embodiment the damper is an integral part of the pressure in balancing mechanism. This provides a compact system.

In a preferred embodiment at least one groove is located on said pin, which groove in the event of separation of said box from said pin, provides space to receive the load transfer segment so as to bring the segment out of engagement with the box, thereby allowing complete separation of the pin and box.

In a further preferred embodiment the weak link comprises a strong mode means adapted to selectively increase the gripping force between said second member and said first member. This reduces substantially or eliminates the risk of accidental or unintended separation when the riser is used for deployment of heavy subsea equipment.

In a preferred embodiment the strong mode means comprises and a strong mode activation dynamic piston operatively coupled to a strong mode locking ring. This provides a reliable means for setting the joint into strong mode.

In an even further embodiment the strong mode means further comprises a first hydraulic fluid pressure conduit that is adapted to deliver hydraulic pressure to a first chamber for displacing the dynamic piston in a first direction and hence displace the locking ring radially into a groove in the box. This provides a simple means for setting the joint into strong mode.

In an even further preferred embodiment the strong mode means further comprises a strong mode static piston situated on the axially opposite side of the locking ring relative to the dynamic piston. This provides a reliable seal for separating the strong mode hydraulically from other parts of the joint.

In a further preferred embodiment the strong mode means further comprises a hydraulic second conduit adapted to deliver hydraulic pressure to a second chamber opposite of the first chamber relative to the dynamic piston for displacing the dynamic piston in a second direction opposite to the first direction, and hence displace the locking ring radially out of the groove in the box. This provides a simple and reliable means to deactivate the strong mode.

BRIEF DESCRIPTION OF THE DRAWINGS

Having described the main features of the invention above, a more detailed and non-limiting description of two exemplary embodiments will be given in the following paragraphs, with reference to the drawings.

DETAILED DESCRIPTION OF THE INVENTION

Figure 1:
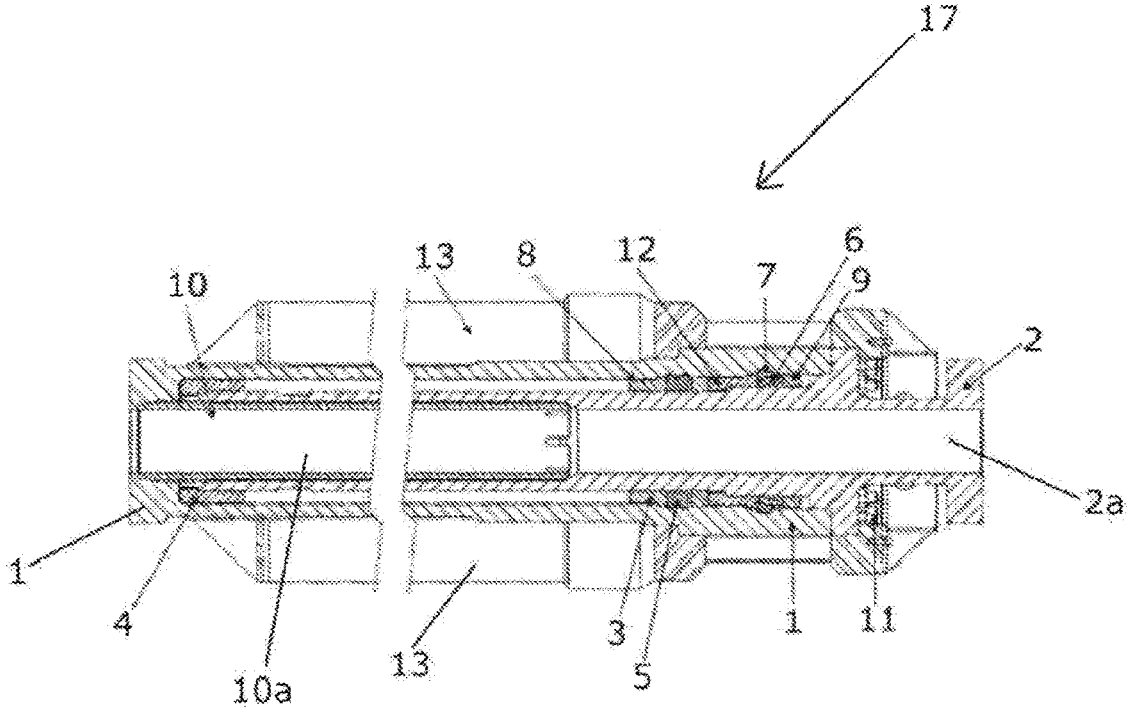
FIG. 1 is a cross-sectional view of the weak link according to a preferred embodiment of the present invention.

The following paragraphs describe two preferred embodiments of the present invention which are purely exemplary for the sake of understanding the invention and non-limiting.

In all the figures from 1 to 6*a* 6*b*, 6*c*, 6*d* and 6*e*, all of which describe one preferred embodiment, like reference numerals represent like features. This is true for FIGS. 7 to 9, 10*a*, 10*b*, 11*a* and 11*b*, which describe another embodiment. Further, when in the following it is referred to as "top", "bottom", "upward", "downward", "above" or "below" and similar terms, this is strictly referring to an orientation with reference to the sea bed, where the sea bed is substantially horizontal and below the riser.

It should also be understood that the orientation of the various components may be otherwise than shown in the drawings, without deviating from the principle of the invention.

It is also clarified that the drawings only show the components of the weak link in detail and not the riser system or other components involved in the operation, as those will be understood by persons skilled in the art.

Furthermore, there can be a plurality of the components for weak mode and strong mode operation, which have been described hereinafter. Only one or only two of each have been described hereinafter or shown in the figures, for the sake of ease of understanding only and not for any limitation. Additionally, hereinafter at places the weak link has been referred to as safety joint/joint. All these terminologies indicate the weak link 17, 43.

FIG. 1 is a view of a preferred embodiment indicating the different components of the weak link 17. It shows a pin 2, which is the internal pressure containing pipe of the joint/weak link and forms a part of the well flow conduit through the joint, having a bore 2*a*. It holds a riser connection at the bottom (i.e. right hand side in the figure) to interface with other riser joints. It is connected to a box 1 by release bolts 11. The box 1 functions as the outer sleeve of the weak link 17 and holds a riser connection at the top (left hand side in the figure) to interface with other riser joints.

The box 1 and the pin 2 are the two main components of the link and these two are releasably connected by the bolts 11. The bolts 11 are constructed in such a way, as known per se, that those will break if the tension exceeds a predetermined value.

A stinger 10 functions as the inner sleeve of the weak link. It is connected to the box 1 preferably by threaded connections (not shown in detail) and fits with a small but distinct clearance at the inside of the pin 2 to ensure pressure balance and fluid containment throughout the stroke. The stinger also forms a part of the well flow conduit through the joint, having a bore 10*a*.

FIG. 1 also shows the upper pressure balance piston(s) 4 and the lower pressure balance piston(s) 3. The pressure balance pistons are situated at a mutual distance, which is at least the same as one bore diameter of the bore 10*a*. The distance may be greater than this to allow for more time to close safety valves to prevent spill of hydrocarbons or drill mud to the environment. Pressure balance load segments 5 or load transfer segments 5 are located below the lower pressure balance piston(s) 3. These will be explained in detail below.

The features which enable the strong mode activation of the weak link are located at the lower portion of the box 1. Those comprise a dynamic strong mode piston 9 above which is situated a strong mode locking sleeve 6 and a split ring 7 above this. Above the split ring 7 is located a strong mode static piston 12. The functioning of these components is explained later.

FIG. 1 also shows bore seals 8 which seal the bore for pressure balancing and dampers 13 that extend along the outer periphery of the weak link 17.

Figure 2:
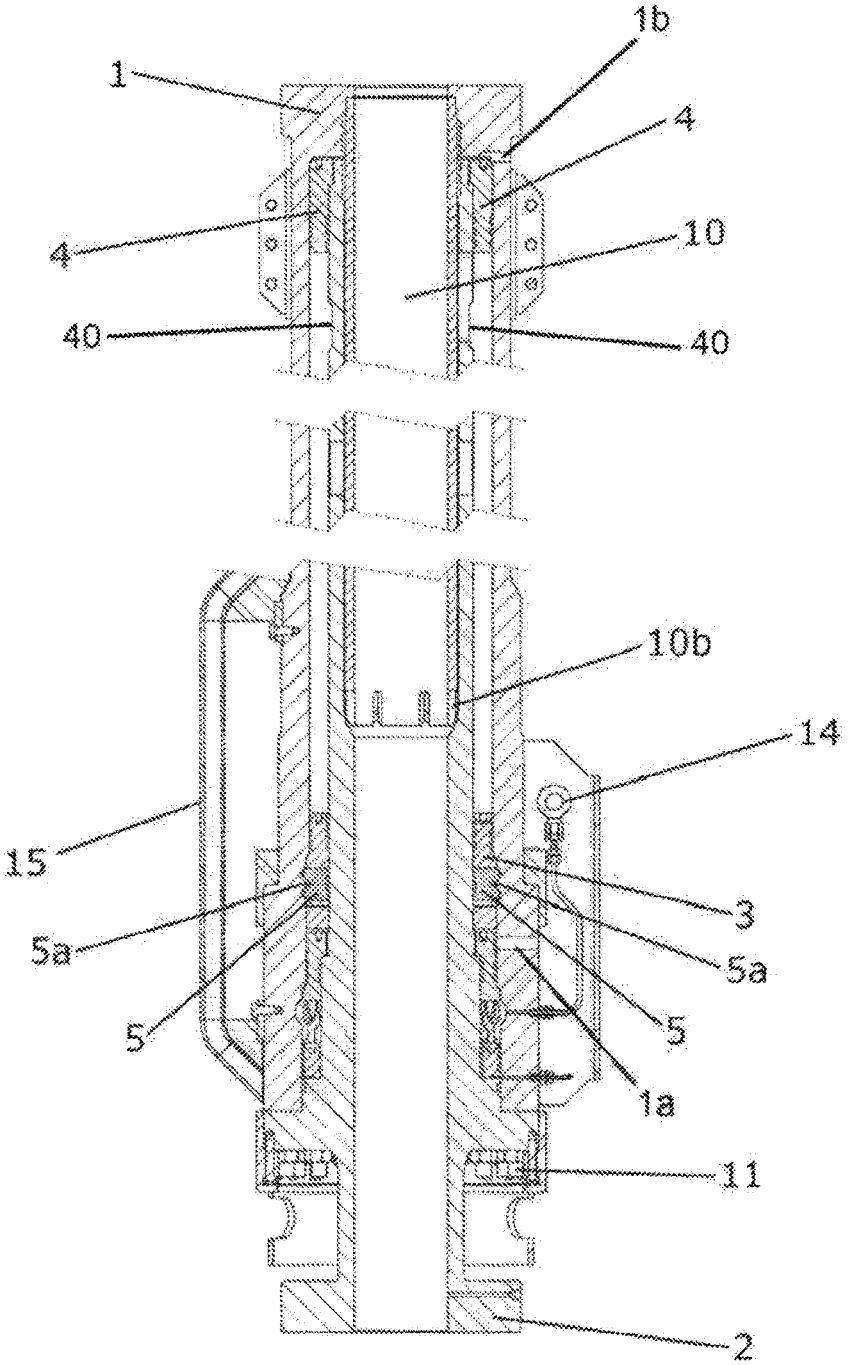
FIG. 2 is an enlarged cross-sectional view of the weak link shown in FIG. 1 operating in weak mode.

FIG. 2 is a cross-sectional view showing the components in FIG. 1 more elaborately. This figure also shows the handle 15, which may be used by an ROV for the purpose of gripping the weak link. Also shown are grooves 5*a*, located in the box 1, with which the pressure balance load segments 5 remain locked into under normal operation. The figure also shows a lower small aperture 1*a* and an upper small aperture 1*b*. Also shown is a hydraulic hot stab 14, which may be accessed by an ROV to exert hydraulic pressure in a hydraulic line 23 to deactivate the strong mode.

Figure 3:
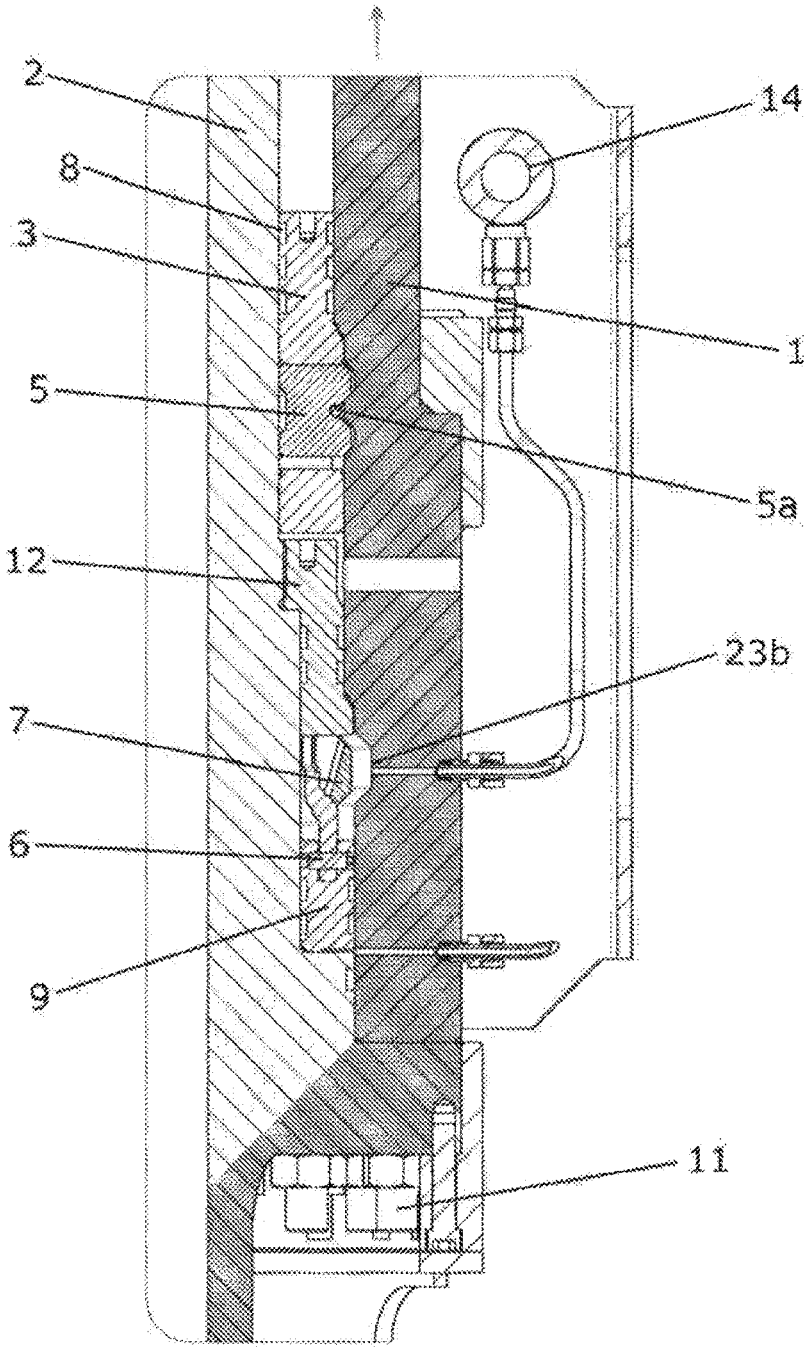
FIG. 3 is a more elaborate cross-sectional view of the lower portion of the weak link shown in FIG. 2, showing the weak mode operation of the weak link.

FIG. 3 is a view of an enlarged portion of the lower part of the weak link 17 which is shown in FIG. 2. Other than the features shown in the previous figures, it also shows a groove 23*b* in the lower part of the box 1 inside which the split ring 7 can be received. There is also shown a hole 1*a* extending through the wall of the box 1. The function of this will be explained later.

Figure 4:
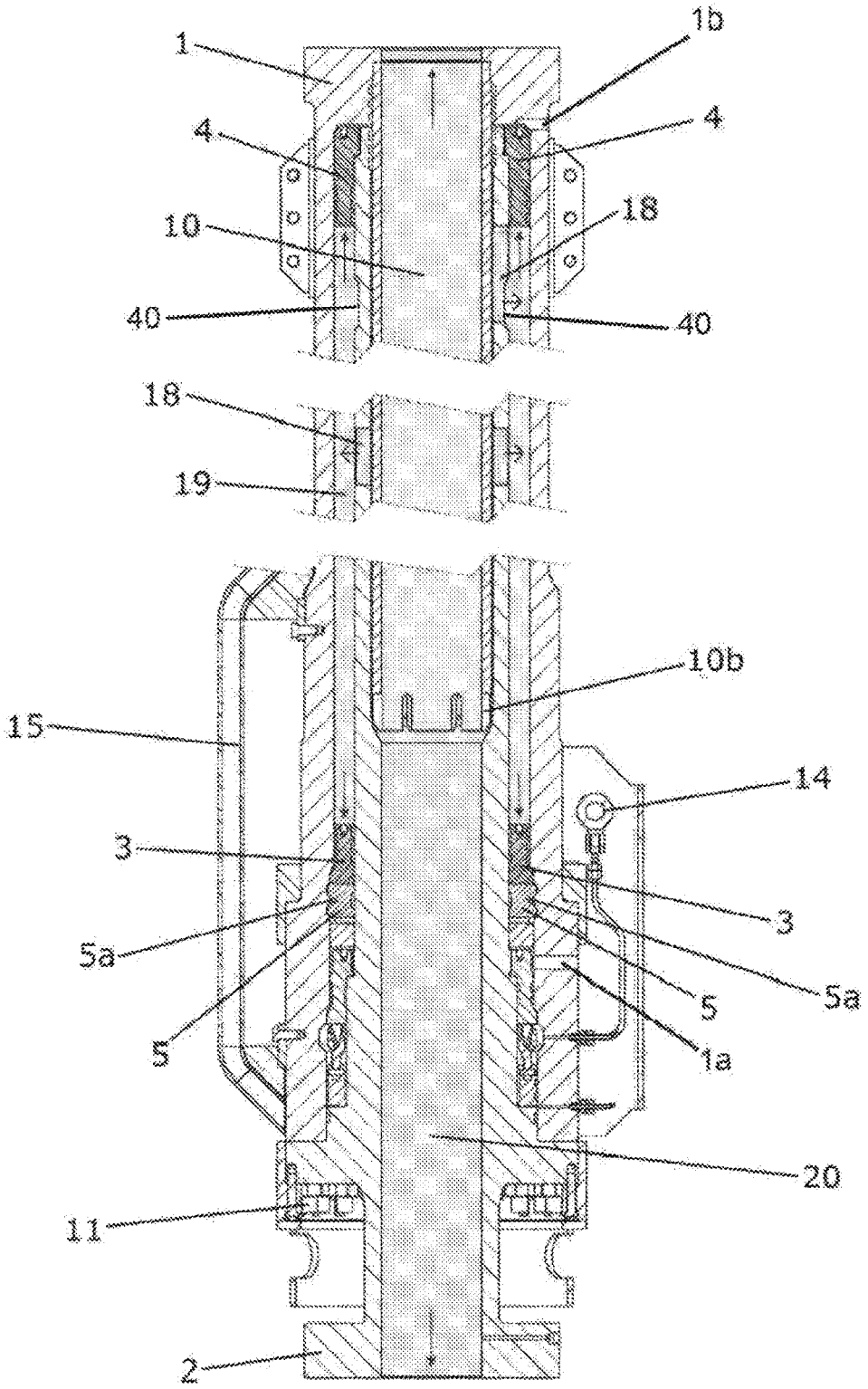
FIG. 4 is an enlarged cross-sectional view of the weak link similar to the one shown in FIG. 2, indicating the pressure balancing mechanism.

FIG. 4 is an enlarged cross-sectional view of the weak link similar to the one shown in FIG. 2. In addition to the features shown in the previous figures, it also shows slits 10*b* at the lower part of the stinger 10, openings 18 in the middle and upper part of the pin 2 and the annulus 19 between the pin 2 and the box 1.

In the same area as the upper openings 18 is formed a circumferential recess 40.

Figure 5:
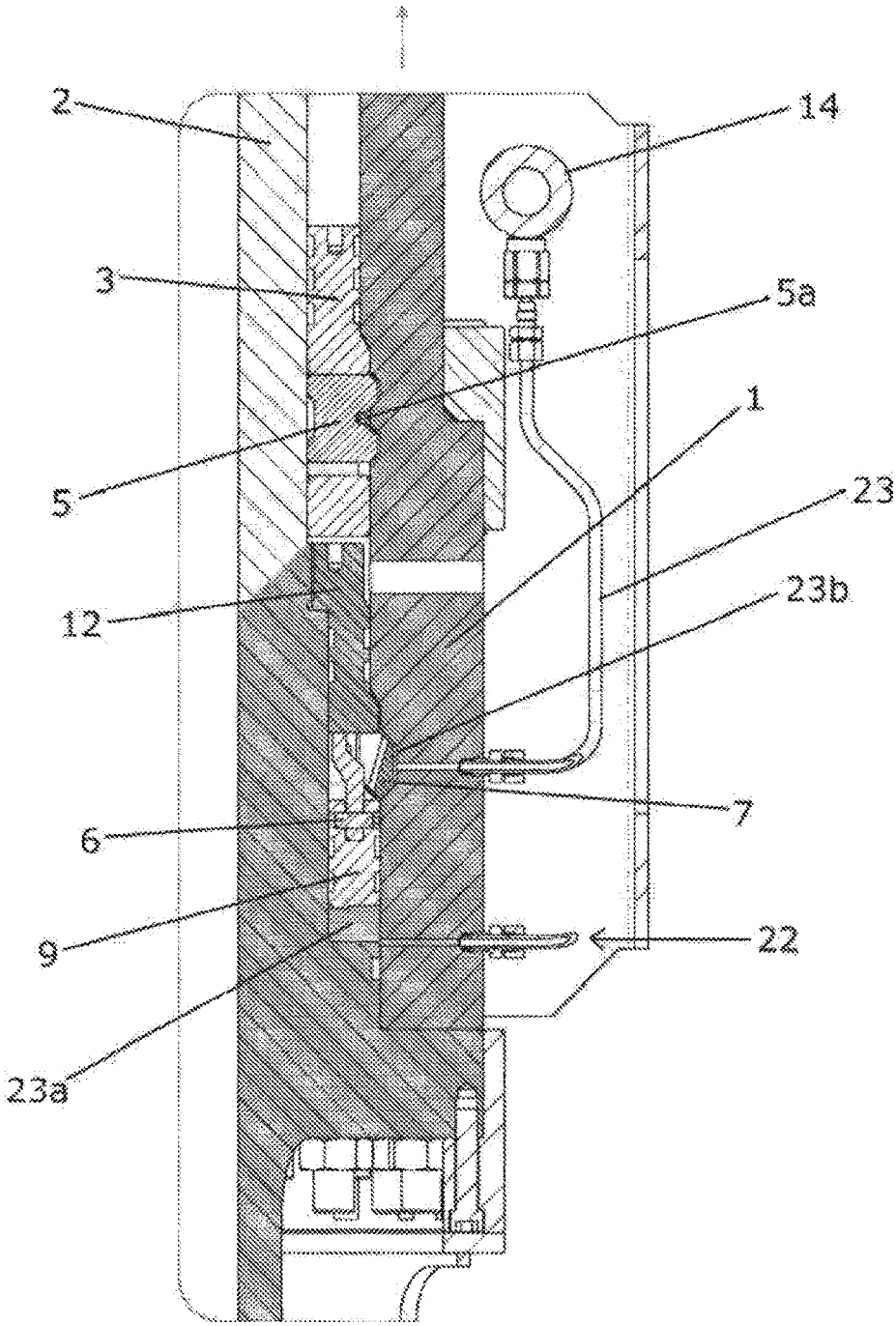
FIG. 5 is a more elaborate cross-sectional view of the lower portion of the weak link similar to FIG. 2, but showing the strong mode operation of the weak link.

FIG. 5 is a more elaborate cross-sectional view of the lower portion of the weak link similar to FIG. 3, but it shows the strong mode operation of the weak link, which is explained later. This figure also shows a chamber 23*a* immediately beneath the dynamic piston 9 and also hydraulic lines 23 and 22 through which hydraulic pressure can be applied.

Figure 6A:
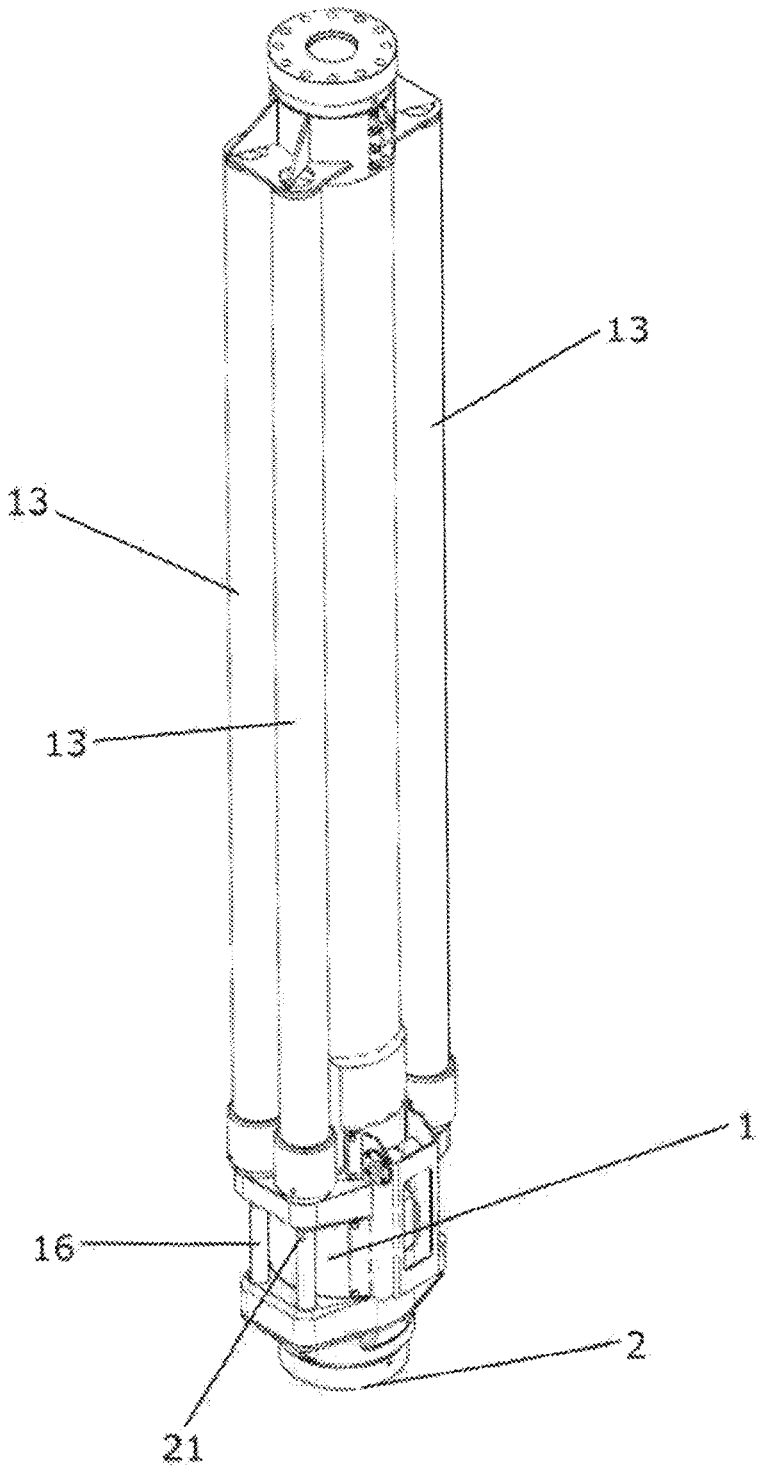
FIG. 6*a* is a perspective view of the damping mechanism of the weak link shown in FIGS. 1 to 5.

FIG. 6*a* shows four dampers 13, which are located on the outer periphery of the safety joint 17. The dampers 13 are cylindrical tubes with piston arrangement 16. The cylinders of the dampers 13 are secured to the box 1 while the piston rod 16 of the dampers extends inside the cylinders to their top end. Longitudinal grooves 21 are present on the piston rods 16, for release of seawater as will be explained later.

The FIGS. 6*b*, 6*c*, 6*d* and 6*e* show the various stages of separation of the weak link 17 when the box 1 separates from the pin 2.

Having described the basic structures of the weak link 17, first the functioning of the pressure balancing mechanism of the weak link will be explained with reference to FIGS. 1 and 4 in particular. As the riser is subjected to internal pressure when connected, the safety joint 17 contains a pressure balancing mechanism that makes sure that this pressure is not exerting any axial force on the bolts 11 due to the end-cap effect, and thereby reducing the operational window of the safety joint 17.

Referring back to FIG. 1 again, the box 1 functions as the outer sleeve of the joint and holds a connection at the top to interface with other riser joints. The pin 2 may be attached directly to a valve tree or an LRP or may have a riser portion beneath.

Referring again to FIG. 4, the stinger 10 is connected to the box 1 preferably by a threaded connection (not shown in detail) and is received with a small clearance along the inside of the pin 2 to ensure pressure balance and fluid containment throughout the stroke. The small clearance provides a narrow annulus (not shown in detail) between the stinger 10 and pin 2, and through this annulus pressure is communicated between the pin bore 2*a* and an annulus 19 between the pin 2 and the box 1. Apertures 18 in the pin 2 provide communication between the narrow annulus and the annulus 19.

The lower pressure balance piston 3 and the upper pressure balance piston 4 function to feed back the pressure separation force (due to the end-cap effect) to the box 1 and pin 2 respectively.

As indicated by arrows in FIG. 4, the pressure inside the riser 20 is transferred from the well flow bore through slits 10*b* at the lower part of the stinger 10, through the small annulus between the stinger 10 and the pin 2 and from there through openings 18 in the middle and upper part of the pin 2 into the annulus 19 between the pin 2 and the box 1. At the two ends of this annular enclosure 19 are the two opposed circular pistons 3, 4. The pistons 3, 4 transfer the resultant force to the box 1 and the pin 2 respectively, in opposite directions, as shown, thereby cancelling the effects the internal pressure is exerting on the bolts 11. In FIG. 4, the light grey shaded portions in general indicate fluid path.

Actually, during operation of the well the medium being transferred (gas/oil and so on) is at high pressure, which gives rise to the end cap effect and results in adding tensile force to the riser segments. Since this pressure varies with time and also with the length of the riser, the force acting on the failure bolts 11 of the weak link 17 cannot be exactly ascertained at any point of time. To get around this problem, the pressurized medium being transferred is allowed into the chamber 19 (also shown in FIG. 4) between pressure balancing pistons 3, 4, so that the pressure acts in both directions. The exposed area of balancing pistons 3, 4 being equal to the cross section of the production bore; the opposing forces cancel each other out.

The elongate pressure balancing chamber 19 ensures that the safety joint 17 is able to keep the pressure balance throughout the separation stroke of the joint, as will be explained more detailed below.

Weak mode operation of the weak link 17 is required when the riser system is deployed and is functioning normally. To be precise, at this stage, the tension on the release bolts 11 is below the predefined level and the box 1 and the pin 2 remain connected. This is explained particularly with reference to FIGS. 2 and 3. When the riser is connected to the infrastructure on the seabed, the safety joint 17 is set to weak mode as shown in FIG. 2. At this stage, the bolts 11 connecting the box 1 and the pin 2 are limiting how much force the safety joint can transfer. This way, the maximum permitted force on the riser is known, and if the riser is subjected to a force beyond this calculated maximum, the bolts 11 will fail.

The load transfer segments 5 are engaged with the grooves 5*a* in the box 1. This ensures that the lower pressure balance piston 3 can not move further down.

Consequently, the pressure within the annulus 19 acting on the lower piston 3, will be transferred to the load transfer segments 5 and from these to the box 1. The pressure on the pistons 3, 4 will therefore act to push the box 1 and the pin 2 towards one another. This force pushing the box and pin towards one another will be substantially equal to the force acting to push the pin and box away from one another due to the end cap effect. This is due to the fact that the area of the pistons 3, 4 is substantially equal to the cross sectional area of the bore of the riser and that the pressure in the bore of the riser is communicated to the annulus 19, so that the pressure in the annulus 19 is substantially equal to the pressure in in the bore. Consequently, the only force acting on the bolts 11 is due to the tension in the riser.

Further, as it would be clear from the enlarged FIG. 3, which is a view of an enlarged portion of the lower part of the weak link 17, in FIG. 2, the lower pressure balance piston 3 can not move upwards. This is due to the presence of a ledge 3*a* on the piston that abuts a shoulder 3*b* in the box 1.

FIG. 3 further shows the approximated load path (shaded in dark grey) when the weak link is running in weak mode. Here the dynamic strong mode piston 9 and the sleeve 6 are in their lower most position, and the locking ring 7 is disengaged away from the groove 23*b*.

FIG. 4, described hereinbefore, while explaining pressure balancing, is also a view showing weak mode operation. During weak mode operation there may occur a situation with a sudden need to separate the top portion of the riser system from the lower portion due to increase of tension in the riser and hence a force acting on the release bolts 11 crossing a certain threshold limit. In such a situation the box 1 and the pin 2 will separate, in order to prevent uncontrolled damage on the riser.

In order for the separation process to take place in a dampened manner, to substantially reduce any sudden jerk due to elastic energy in the riser system, is further explained with reference to FIG. 6*a*. As shown in FIG. 6*a* dampers 13, in the form of cylindrical tubes, are located on the outside of safety joint 17 to absorb the sudden jerk on failure of bolts 11 for enhanced safety. These are ideally cylindrical tubes with piston arrangement 16 as best shown in FIG. 6*a*. These are automatically filled with seawater when submerged. The cylinders of the dampers 13 are secured to the box 1 while the piston rods 16 of the dampers extend inside the cylinders to the top end of these. The FIG. 6*a* shows a stage, when separation has not started and the weak link 17 is functioning normally.

To understand how separation of the box 1 and pin 2 takes place, in the event of the tension in the riser reaching and crossing a predefined limit, reference is now in again made to FIG. 1. Here it is clarified to avoid any confusion, that during the separation, the pin 2 remains stationery in attachment with some equipment/riser system on the sea bed and the box 1 moves axially upwards relative to the pin 2. The joint may however, be configured the other way around, so that the pin moves upward while the box is stationary.

In the event of failure of bolts 11, the lower pressure balance piston 3 moves axially with the box 1 when the box 1 is commencing the separation from the pin 2, since the load transfer segments 5 are locked in the groove 5*a* in the box 1.

The top portion of the upper pressure balance piston 4 has preferably threads (not shown in detail) that positively attaches the piston 4 to the upper end of the pin 2. Consequently, the upper piston 4 will move downward relative to the box 1 (i.e. the box moves upward while the piston is stationary). As this creates a void on the upper side of the upper piston 4, an small aperture 1*b* is provided through the wall of the box, through which seawater can flow to fill the void.

Figure 6B:
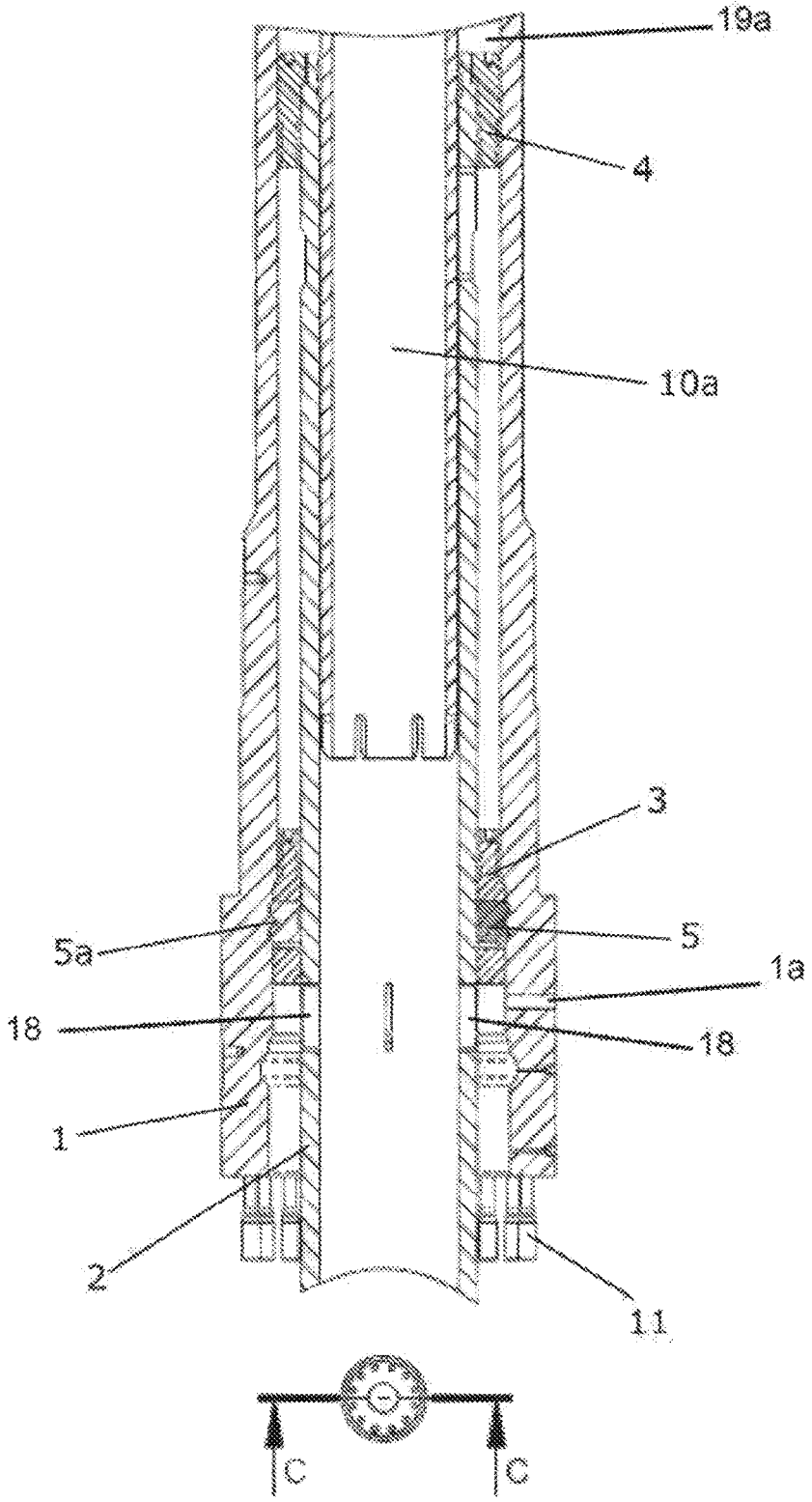
FIG. 6*b* is a sectional view of the weak link along the line C-C showing the beginning of separation.

Referring to FIG. 6*b*, which is a cross sectional view of a portion of the joint, is shown a partial separation of the box 1 and the pin 2. At this stage a set of apertures 18 in the pin have reached the aperture 1*a* in the box 1. The pressure within the bore 10*a* of the joint is bled off into the sea water through these apertures. Due to the upper and lower pistons 3 and 4 moving closer to one another, the fluid in the annulus 19*a* will be pushed through the apertures 18 and into the bore of the riser until the lowermost apertures 18 reach the lower aperture 1*a*. Also during the bleed-off through the lower aperture 1*a* the annulus 19, and the pressure therein acting on the pistons 3, 4, will provide pressure balance to cancel out the end cap effect. Also during the separation, seawater is continuously flowing into the void 19*a* above the upper piston 4.

Figure 6C:
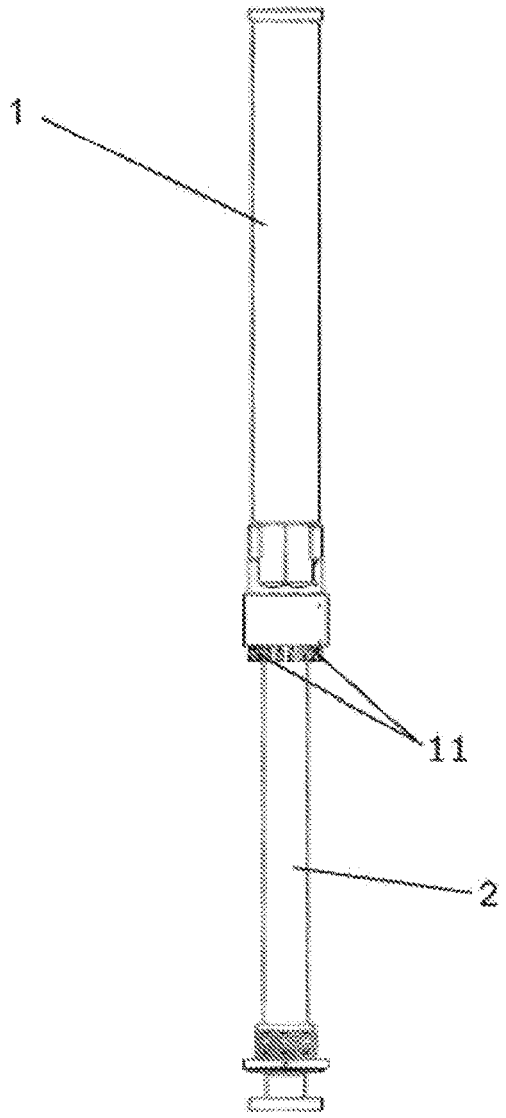
FIG. 6*c* is a front view of the weak link corresponding to the sectional view in FIG. 6*b*.

FIG. 6*c* is a front view of the weak link, which corresponds to the view in FIG. 6*b*. As, it would be clear, the box 1 has moved up relative to the pin 2.

Figure 6D:
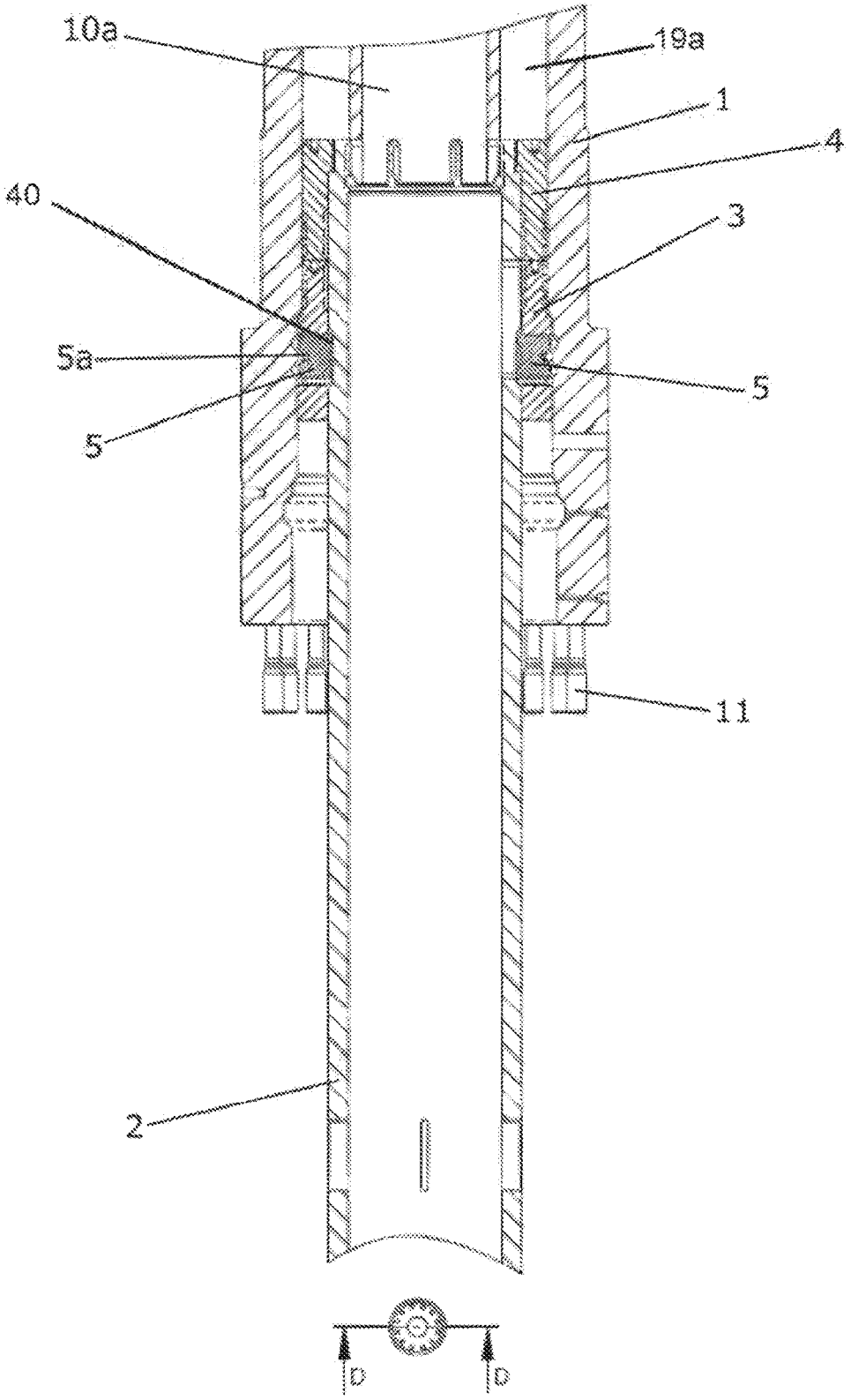
FIG. 6*d* is a sectional view of the weak link along the line D-D, showing a stage of separation which is subsequent to what is shown in FIGS. 6*b* and 6*c*.
Figure 6E:
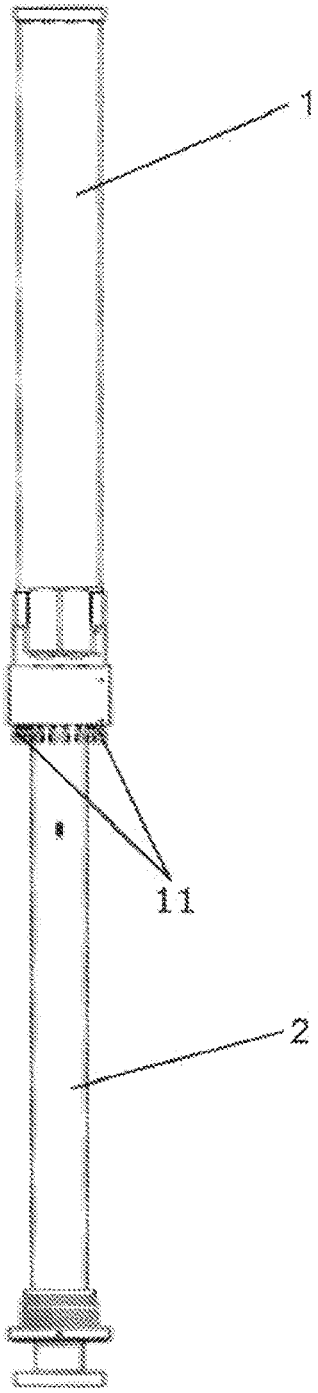
FIG. 6*e* is a front view of the weak link corresponding to the sectional view in FIG. 6*d*.

FIG. 6*d* is a cross-sectional view of a portion of the joint. It is a view of a stage when separation of the box 1 relative to the pin 2 is almost complete. It would be clear from this figure as also from FIG. 6*e*, which is a front view of the weak link corresponding to the view in FIG. 6*d* that the box 1 has moved further up, as compared to what is shown in the views in FIGS. 6*b* and 6*c* and is almost separated from the pin 2. It also shows that the lower pressure balance piston 3 has moved upwards, together with the box 1, relative to the upper balance piston 4 and has in fact met the upper pressure balance piston 4. The void 19 above the upper piston 4 is now filled with seawater.

At this point, a groove 40 in the upper part of the pin 2 has reached juxtaposition with the load transfer segments 5, and allow these to move inwards and out of the grooves 5*a* in the box 1. The locking segments are preferably spring biased inwardly to facilitate this action. The disengagement from the groove 5*a* allows the load transfer segments 5 and the lower balance piston to move downwards with the pin 2 and out of the box 1. Thus, the box 1 now moves axially away from the pin and is fully separated from the pin 2. The dampers, which have also reached their end of the stroke are separated by the piston rods dislodging from the cylinders. This separation may be facilitated through a mechanism of segments in the cylinder 13 that is allowed to expand when the piston at the upper end of the piston rod 16 reaches a certain position.

At the end of the separation, which stage is not shown, the pin 2 remains at the bottom with the upper pressure balance piston 4, the lower pressure balance piston 3 and the load transfer segments 5. The box 1 completely separates and the dampers 13 having the pistons inside release completely from the piston rods 16, which are connected to the pin.

The dampers thus ensure controlled and smooth separation of the box 1 relative to the pin 2 and the risers/equipments attached therewith.

Now the strong mode action of the weak link will be explained, referring to FIG. 5. The strong mode is required to strengthen the joint between the box 1 and the pin 2 when the riser is lowered to the sea bed with heavy equipment, e.g. a EDP/LRP/XT assembly, hanging from its lower end. This is also required when the riser assembly is retrieved.

The strong mode ensures greater gripping force between the box 1 and the pin 2 by reducing the load on the release bolts 11. This strong mode is inactive when the weak link is in normal operation and is subject to well pressure. The strong mode has to remain inactive also, during separation the box 1 and the pin 2 along the release bolts 11.

Strong mode is particularly required to ensure that the bolts 11 do not fail during lowering and retrieval operations, when substantial tension acts on the release bolts 11 of the weak link. This tension may be much greater than the pre-defined tension at which the release bolts 11 are designed to break.

During strong mode operation hydraulic fluid is forced through the valve 22 (best shown in FIG. 5) into a chamber 23*a* at the lower part of the box 1. This forces the strong mode dynamic piston 9 upwards. The piston pushes the strong mode locking sleeve 6, which subsequently forces the split locking ring 7 into a groove 23*b* (best shown in FIGS. 4 and 5) in the lower part of the box 1. The ring 7 is pressed radially outward by the strong mode locking sleeve 6, so that it enters the groove 23*b* and sits in it. The locking sleeve may be designed to keep the locking ring 7 in the groove 23*b* without having to apply a continuous hydraulic pressure in the chamber 23*a*.

Through the locking ring 7, the pin 1 and the box 2 are locked together and hence the bolts 11 are partially relieved, and the overall tensile capacity of the safety joint is increased.

The strong mode is deactivated by releasing the hydraulic pressure through a strong mode deactivating hydraulic line 23, which pushes the sleeve 6 and the dynamic piston 9 back downwards so that the locking ring 7 can move inwards again to disengage out of the groove 23*b* at the lower part of the box 1. When strong mode is deactivated the cavity between the static piston 12 and the dynamic piston 9 contains hydraulic pressure, to ensure that the split ring cannot engage with the groove 23*b*.

The static piston 12 is fixedly attached to the pin 2 by threads. This ensures that the static piston 12 remains static with the pin 2.

Figure 7:
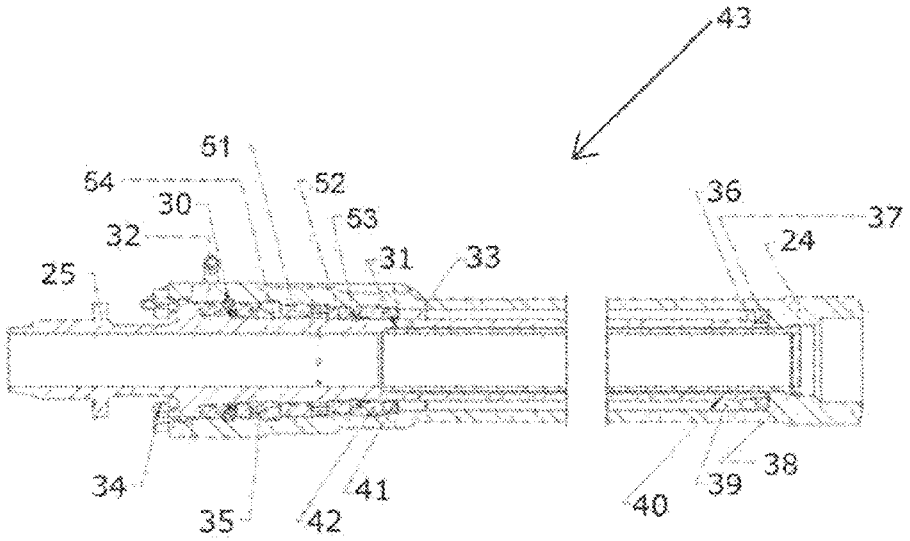
FIG. 7 is a cross-sectional view of the weak link according to another preferred embodiment of the present invention

FIG. 7 is a view indicating the different components of a further embodiment of the weak link 43 of the riser system. The weak link 43 has a pin 25 and a box 24. The pin 25 has a portion of a riser system (not shown) connected at its bottom (left hand side in FIGS. 7 and 8), while the box 24 has a portion of a riser system (not shown) connected at its top (right hand side in FIGS. 7 and 8). The pin 25 and box 24 are releasably connected to each other by release bolts 34. These release bolts 34 are designed to break at a predetermined load. The riser system connected to the pin 25 is either connected to further risers or to other equipments/infrastructure on the sea bed.

There is an upper pressure balance piston 27 for transferring load on the pin 25 and a lower pressure balance piston 26 for transferring pressure load to the box 24. A pressure balance load ring 29 is located above the upper pressure balance piston 27 for transferring load from the upper pressure balance piston 27 onto the pin 25. A pressure balance load segment 28 is located below a lower pressure balance piston 26 for transferring pressure load from the lower pressure balance piston 26 onto the box 24.

A strong mode load segment 30 is located above a strong mode activation ring 32, which is in contact with both the pin 25 and the box 24. The upper part of the pin 25 forms an anti-recoil piston rod with an upper anti-recoil piston 36 at the end. The upper part of the box 24 forms an anti-recoil cylinder 39 with a lower anti-recoil piston 41 at its lower end.

An anti-recoil load ring 37 is located above the upper anti-recoil piston 36, while an anti-recoil support segment 42 is located below the lower anti-recoil piston 41 for supporting these.

A stinger 33 is arranged within the upper part of the pin 25 to contain pressure in the joint 43. Bore seals 31 are provided at the end of the stinger 33 to prevent leakage.

FIG. 7 also shows the location of the anti-recoil support segment groove 40, the stinger retainer 38.

Figure 8:
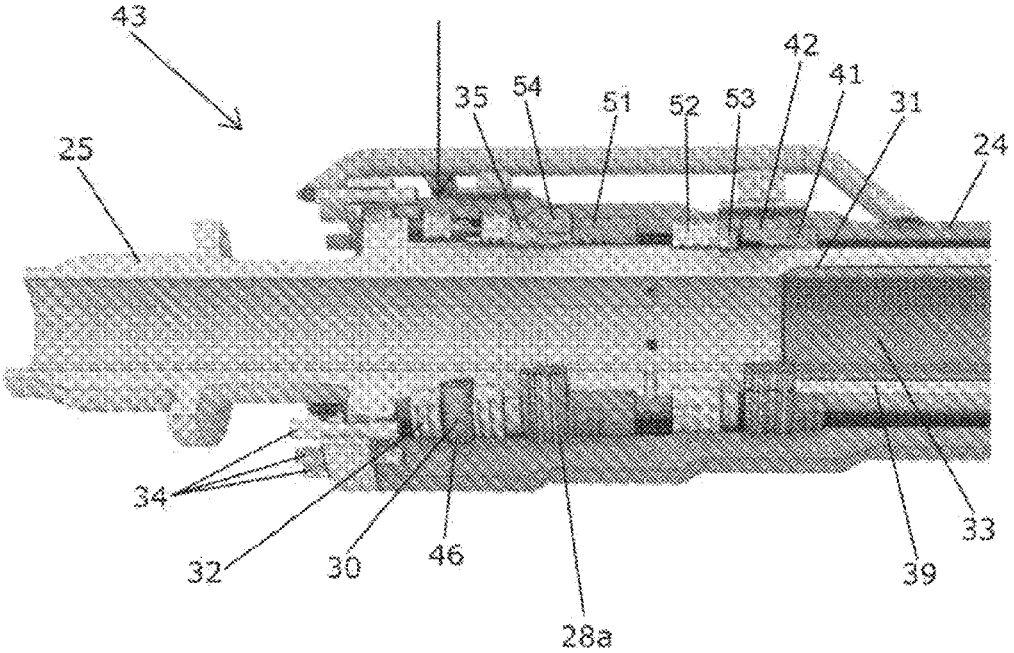
FIG. 8 is an enlarged cross-sectional view of a portion of the weak link shown in FIG. 7.

The disposition of the various components of the weak link 43 as described hereinbefore with reference to FIG. 7 are further elaborated in the enlarged view in FIG. 8, which show only the lower part of the joint 43.

FIG. 8 also clearly shows a strong mode load segment 30 located above the strong mode activation ring 32 and that this sits in a groove 46 in the box 24. The ring 32 is in contact with the pin 25 and the box 24. FIG. 8 also shows a groove 28*a* in the lower part of the box 24, with which the pressure balance load segment 54 remains in engagement, when the box 24 and the pin 25 are connected.

Figure 9:
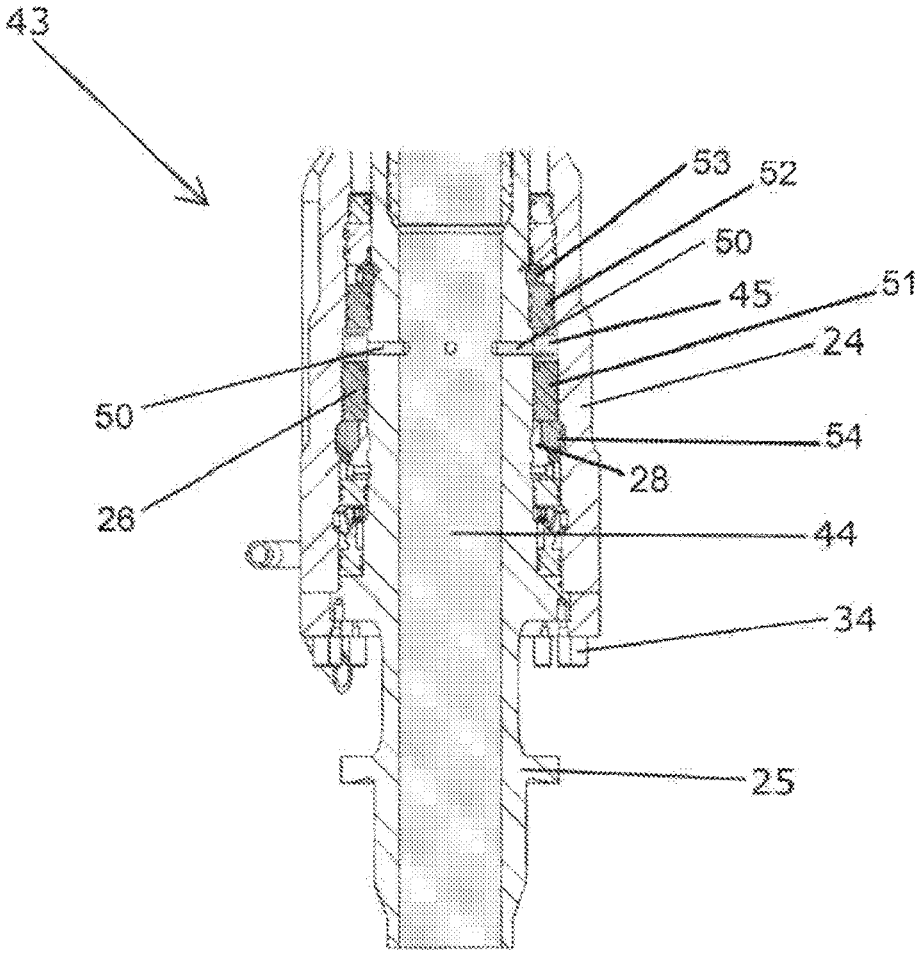
FIG. 9 is a front view of the embodiment of the weak link in FIGS. 7 and 8 showing the pressure balancing mechanism

FIG. 9 is a view showing the pressure balancing, when the joint 43 is under weak mode operation. It shows the pressure balancing chamber 45 between the box 24 and the pin 25 and the openings 50 through which pressure in the riser 44 is conveyed to the chambers 45.

Figure 10A:
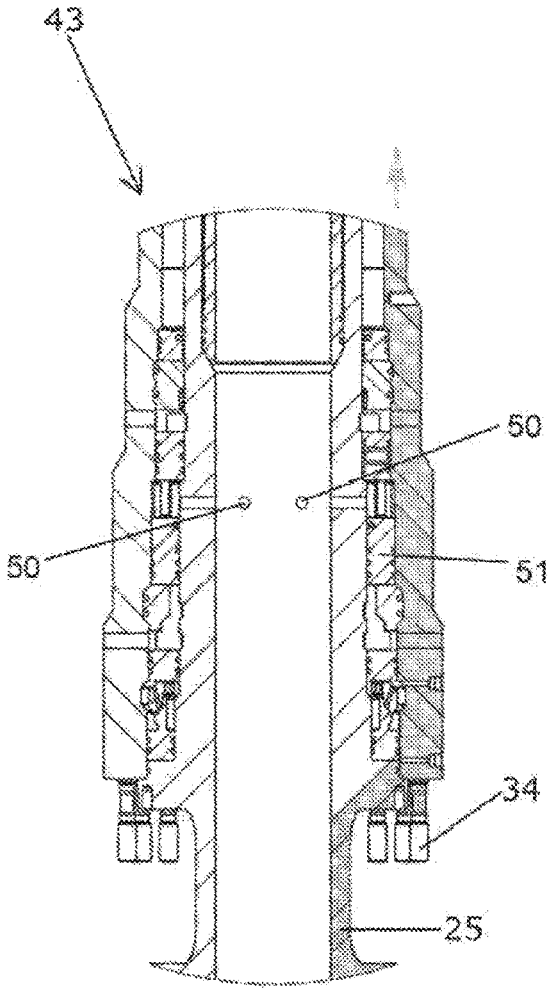
FIGS. 10*a* and 10*b* are front views of the preferred embodiment of the weak link in FIGS. 7 and 8 showing working in weak mode and strong mode respectively.
Figure 10B:
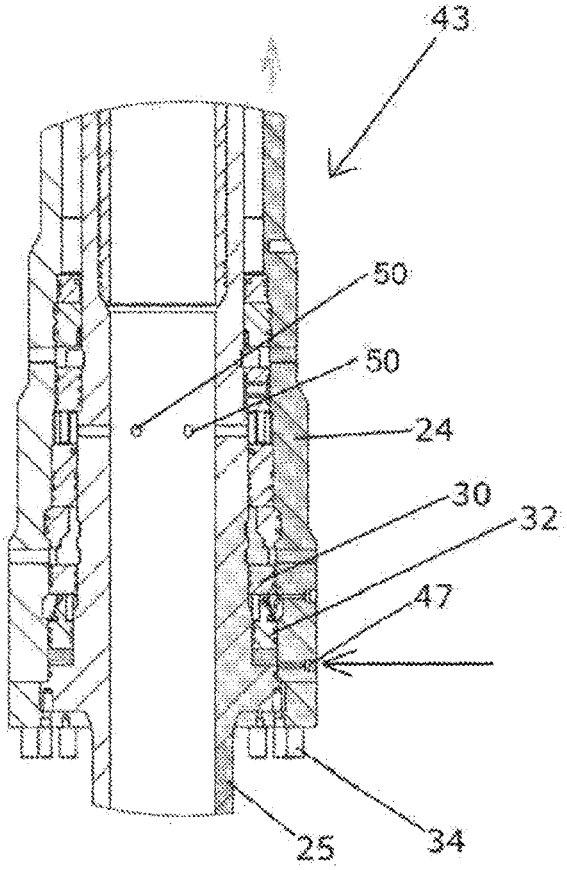

FIG. 10*a* is a view showing the weak mode operation while FIG. 10*b* is a view showing the strong mode operation. FIG. 10*a* shows the openings 50 through which pressure is conveyed from the riser to the pressure balancing chamber 45 best shown in FIG. 9. It also shows the box 24, the pin 25 and the release bolts 34. FIG. 10*b* shows these features and additionally shows the static strong mode piston 30 above the strong mode activation piston 32 and the strong mode activation port 47.

Figure 11A:
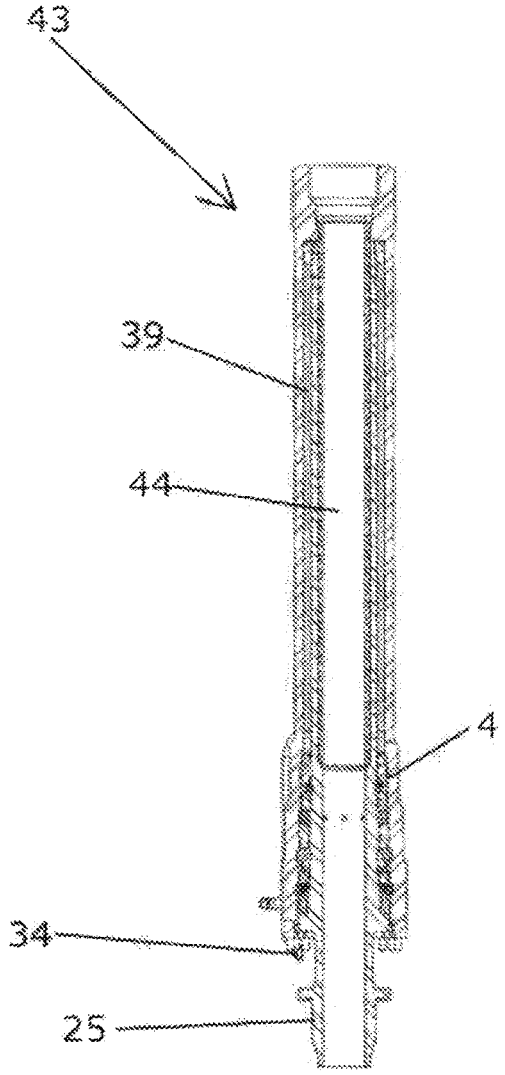
FIGS. 11*a* and 11*b* are enlarged front views of the embodiment of the weak link in FIGS. 7 and 8, showing working of the damping mechanism.
Figure 11B:
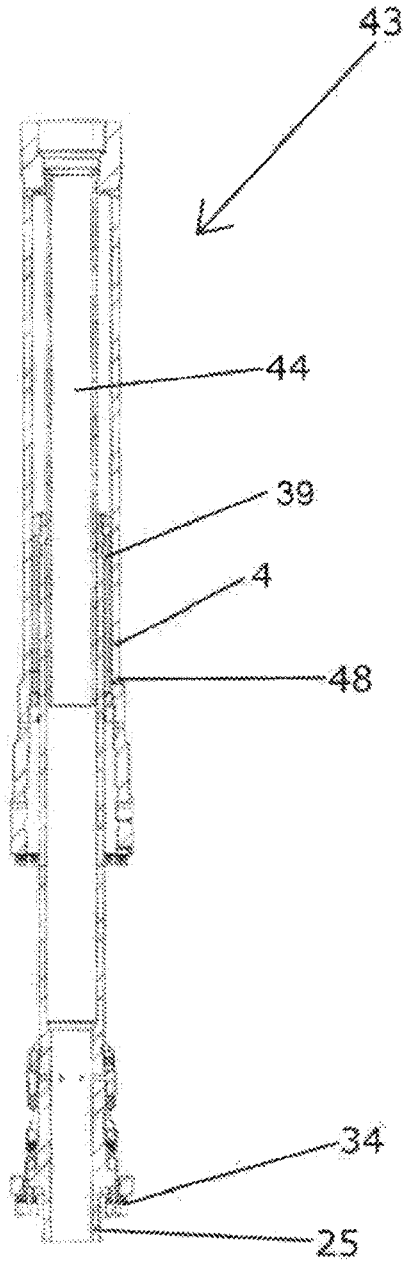

FIGS. 11*a* and 11*b* are views showing the damping mechanism for dampened separation of the box 24 and the pin 25. There is an annular chamber 39 between the pin 25 and the box 24. This chamber 39 is filled with sea water, when submerged, through holes 48 (shown in FIG. 11*b*) at the lower part of the box 24. The shaded portion in the FIG. 11*b* indicates water in the cavity 39.

The pressure balancing mechanism during weak mode operation will now be explained with reference also to FIGS. 7, 8 and 9.

When the riser 44 is fully deployed the weak link is in weak mode, where the bolts 34 connecting the pin 25 and box 24 are limiting how much force the weak link 43 can support. This way the maximum permitted force on the riser 44 is known, and if the riser is subjected to force beyond this calculated maximum the bolts 34 will fail.

A force acts on the riser system due to end cap effect which needs to be first of all balanced by the pressure balancing mechanism of the weak link 43, in order to cancel out the axial force exerted on the release bolts 34 due to pressure in the riser.

As particularly shown in FIG. 9, the pressure inside the riser 44 is transferred through openings 26 into a chamber 45 between the pin 25 and the box 24 where it exerts force on two opposed circular pistons (a lower pressure balance piston 51 and an upper pressure balance piston 52, as best shown in FIGS. 7 and 8) each of which transfers the resulting force respectively to the box 24 and the pin 25 in opposite directions. Thus the effects of the internal pressure on the bolts 34, is cancelled out.

A pressure balance load ring 54 is located above the upper pressure balance piston 52 for transferring the pressure load from the upper balance piston 52 to the pin 25. Similarly, a pressure balance load segment 54 is located below the lower pressure balance piston 51 for transferring pressure load from the lower pressure balance piston 51 to the box 24. These segments 54 are so constructed that they may move radially and allow the box 24 to release, once the bolts 34 break. When the box 24 and the pin 25 remain connected, the segments 54 are in engagement with the grooves 28*a* in the box 24 by a holding ring 28 that has a chamfered surface, as best shown in FIG. 9.

When, the threshold limit of the release bolts 34 is crossed, the box 24 and the pin 25 start separating, the holding ring 28 will move downward with the pin and the segments 54 are allowed to move radially inward to disengage from the box.

Towards the end of the stroke a groove 40 will reach anti-recoil support segment 42 allow this to move radially into the groove 40 in the pin and hence out of engagement with the box 24, thus allowing the pin 25 to pass all the way out of the box 24 and separation to occur.

Without any form of dampening, this separation would be like a rubber band breaking, and the resulting recoil has potential chances of damaging the subsea infrastructure as well as equipment and personnel on the surface.

To avoid any recoil during separation of the box and the pin, the weak link 43 is designed with a built-in recoil prevention system to minimize any recoil. This mechanism will now be explained with reference to FIGS. 11*a* and 11*b*.

The recoil prevention mechanism works by providing a chamber 39 between the upper parts of the pin 25 and the box 24, this chamber 39 is filled with sea water through holes 48 (shown in FIG. 11*b*) at the lower part of the box 24. When the weak link separates, the water is forced slowly out again through the holes 48.

The holes 48 are so sized that the water is restricted in its flow, thus providing an effective damping to the separation movement. This causes the separation process, or the stroke, to be limited to an acceptable speed, thereby limiting the impact of the released energy.

FIG. 11*a* is a view of a stage when the box 24 and the pin 25 have not started to separate and seawater (shaded portion) is present in the chamber 39.

FIG. 11*b* is a stage when the separation has begun by breaking of the bolts 34. The box 24 has moved upwards relative to the stationery pin and water is partially expelled so that it is now present only in the cavity portion 39*a*.

Thus the pressure balancing mechanism of the weak link works in association with the anti-recoil mechanism of the weak link. However, as opposed to the in embodiment of FIGS. 1-6, the pressure balance feature will not work after the bolts 34 have been broken. This means that the damper mechanism deals with both the end cap effect and the riser tension forces, namely, the axial force acting on the release bolts due to end cap effect of the riser is cancelled out and that the pin and the box separate in a controlled and smooth manner, without any sudden snap when the release bolts reach the threshold value as preset.

The strong mode operation is explained further with reference to FIGS. 10*a* and 10*b*. FIG. 10*a* shows the approximate load path (shaded portion) when the weak link 43 is set in weak mode and FIG. 10*b* shows the approximate load path (shaded portion), when the weak link 43 is set in strong mode. By comparing FIGS. 10*a* and 10*b* it can be seen that in FIG. 10*a* the strong mode activation piston 32 is in its lowermost position, whereas in FIG. 10*b* the piston 32 has been displaced to its uppermost position, and hence the strong mode has been activated.

As shown in FIG. 10*b*, to activate the strong mode, hydraulic pressure is applied through a port 47 located near the lower part of the box 24 and below the piston 32, whereby the piston 32 is pushed upward and in turn pushes the load segment 30 axially into a groove 46 (best shown in FIG. 8) in the box 24. Hence, the gripping force between the pin 25 and the box 24 is increased. This strong mode application of hydraulic force, thus substantially increases the strength of the weak link 43 by ensuring greater contact between the pin 25 and box 24. Naturally, in that event, the load on the release bolts 34 is also reduced.

Referring to FIGS. 12*a-d*, 13*a-d* and 14*a-c*, a preferred embodiment of the damper 13 shown in FIG. 6*a* will be described.

Figure 12A:
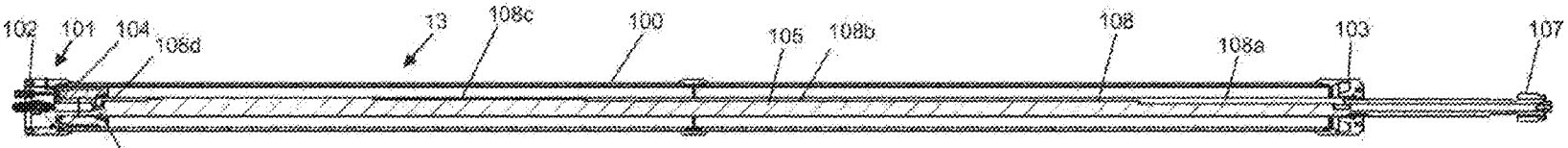
FIG. 12*a* shows a longitudinal section of a damper according to the invention in a fully retracted position.

FIG. 12*a* shows a longitudinal section through a damper 13. The damper comprises a cylinder 100 that is sealed at a first end 101 by a first open ended end cap 102. At the opposite second end 103, is a second end cap 103. Within the cylinder 100 is a piston 104. A piston rod 105 is attached at a first end 106 to the piston 104 and the piston rod extends out through the second end cap 103 to a second end 107 that is outside the cylinder 100. In FIG. 12*a*, the damper 13 is in the fully retracted position, i.e. the piston 104 is next to the first end cap 102.

A longitudinal groove 108 is formed along the piston rod 105. This groove is stepped in depth as follows (from the outer end to the piston 104): an outer deeper groove portion 108*a*, an intermediate shallower groove 108*b* and an inner shallowest groove 108*c*. In addition there is a short deeper groove 108*d* closest to the piston 104.

Figure 12B:
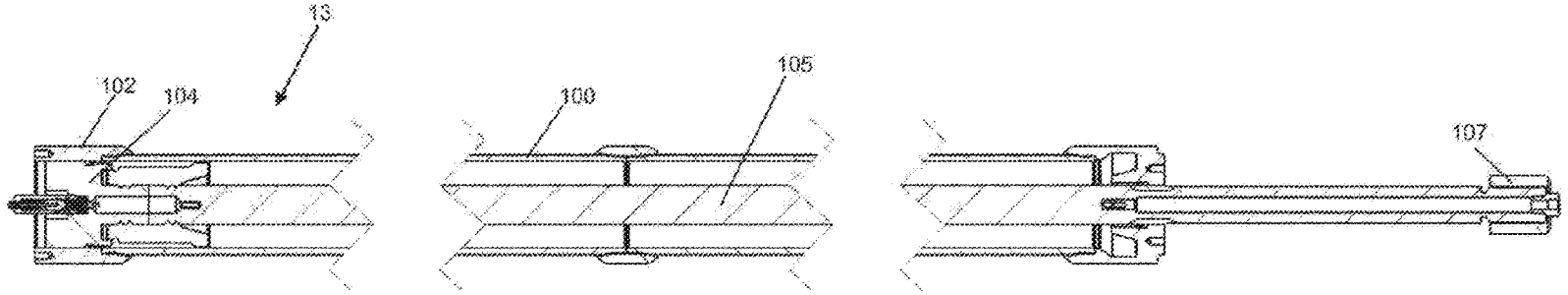
FIG. 12*b* shows a partial longitudinal section of the damper in a fully retracted position transverse to the cross section of FIG. 12*a*.

FIG. 12*b* shows the damper 13 in a partial longitudinal section 90° to the section in FIG. 12*a*.

Figure 12C:
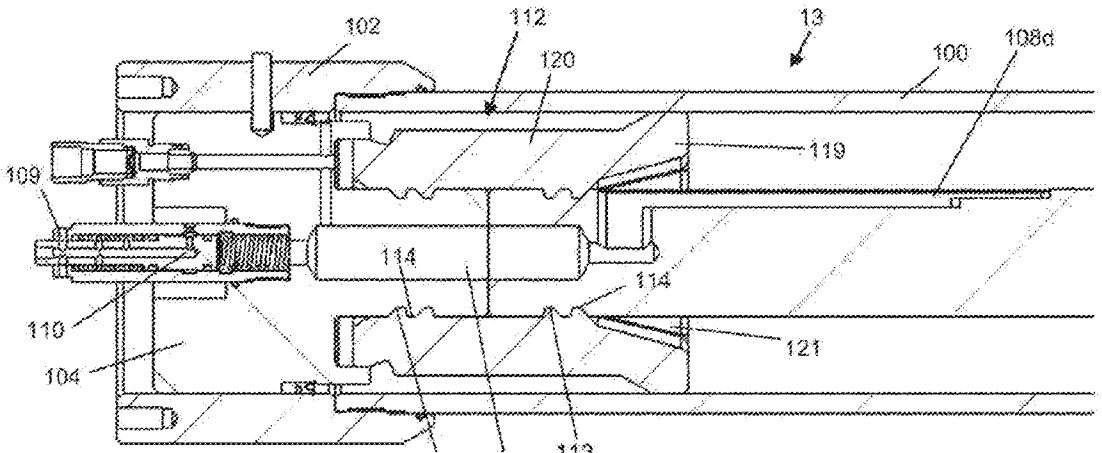
FIG. 12*c* shows a longitudinal section of a first end of the damper in a fully retracted position.

FIG. 12*c* show a detailed longitudinal cross section of the inner end 101 of the damper 13 in the same view as in FIG. 12*a*. It shows the piston 104 and the end cap 12. The piston is equipped with a connecting piece 109, a one way valve 110 and a fill channel 111, to fill the cylinder 100 with hydraulic fluid. The channel 111 is in communication with the innermost groove 108*d*.

Distal of the piston 104 is a gripping mechanism 112 that forms a connection between the piston 104 and the piston rod 105. The gripping mechanism comprise a plurality of dogs 120 that couple the piston 104 and the piston rod 105 by intermeshing grooves 113 and projections 114. The dogs 120 have a distal end 119 that extends obliquely outward from the piston rod 105 to the inner wall of the cylinder 100. Thereby a conical cavity 121 is formed between the rod 105 and the distal end of the dogs 120.

Figure 12D:
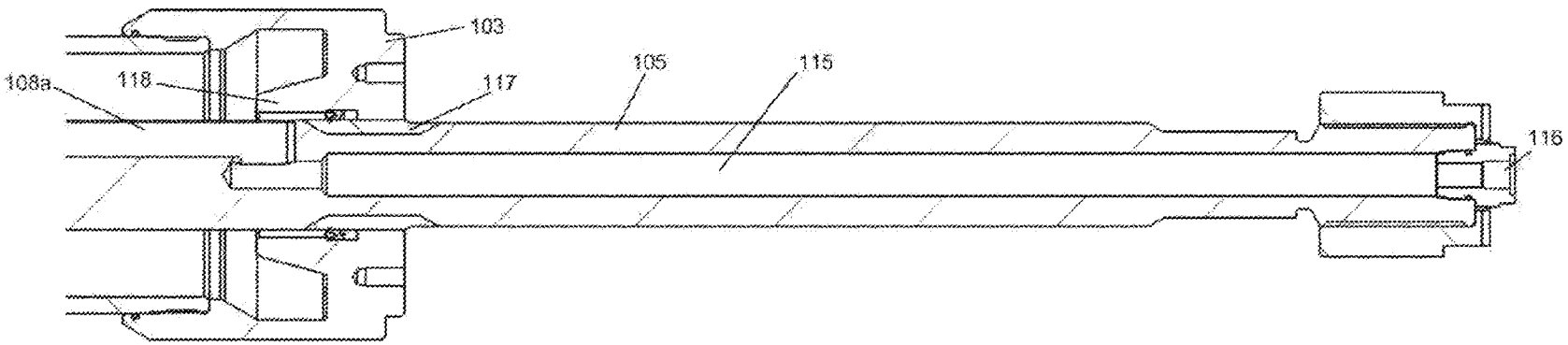
FIG. 12*d* shows a longitudinal section of a second end of the damper in a fully retracted position.

FIG. 12*d* shows a detailed view of the outer end of the damper 13 in the same section as in FIG. 12*a*. The piston rod 105 has a bore 115 that puts the outermost groove 108*a* in communication with the surroundings through an opening 116 in the distal end of the piston rod 105. In addition the rod has a circumferential groove 117 that also puts the interior of the cylinder 100 in communication with the surroundings.

The end cap 103 has an inwardly ring shaped projection 118, the function of which will be explained later.

Figure 13A:
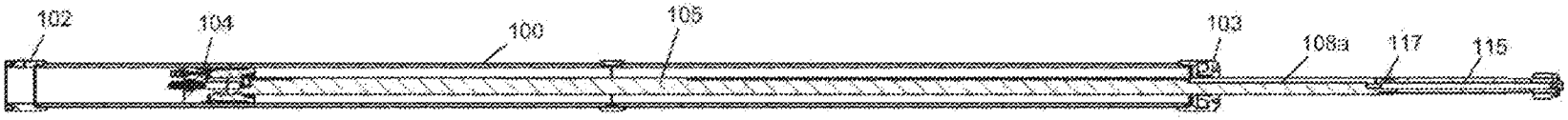
FIG. 13*a* shows a longitudinal section of the damper in a partially extended position.
Figure 13B:
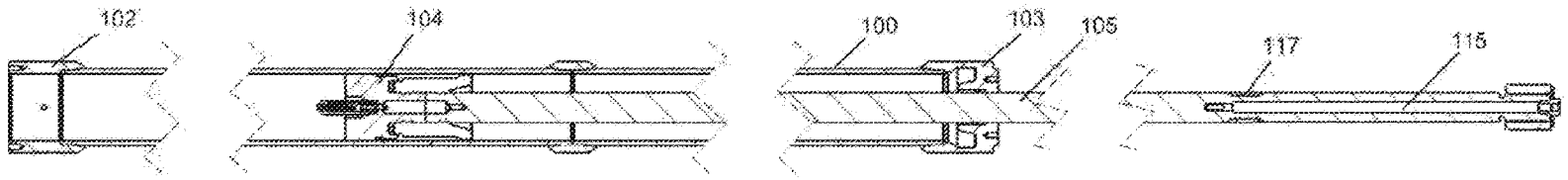
FIG. 13*b* shows a partial longitudinal section of the damper in a partially extended position transverse to the cross section of FIG. 13*a*.
Figure 13C:
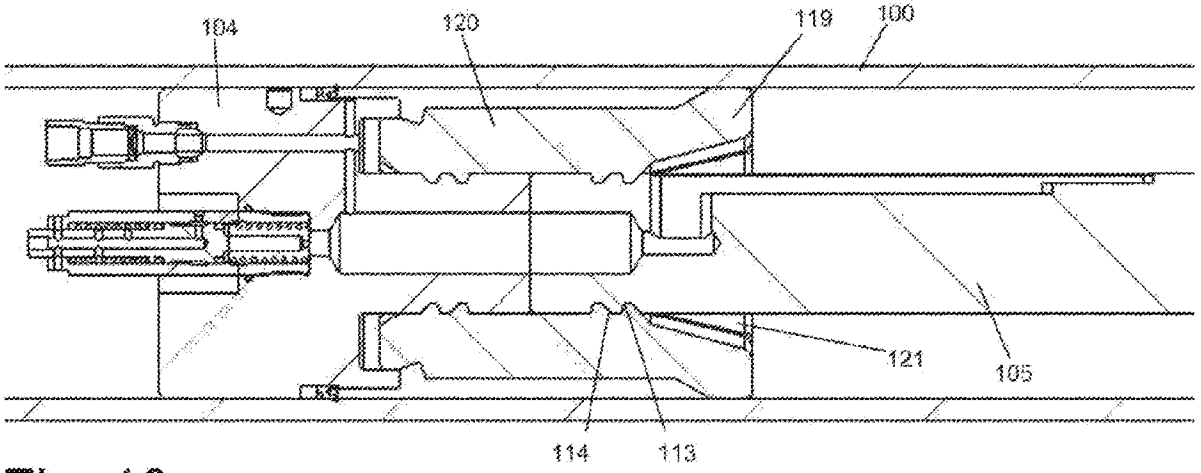
FIG. 13*c* shows a longitudinal section of a first end of the damper in a partially extended position.
Figure 13D:
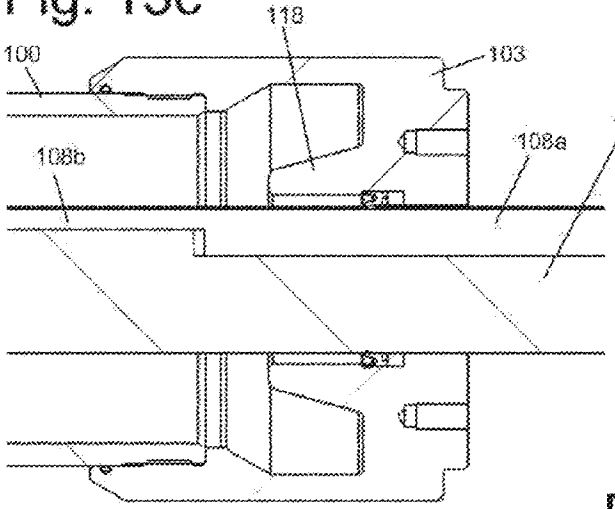
FIG. 13*d* shows a longitudinal section of a second end of the damper in a partially extended position.

When the force of acting to separate the box 1 and pin 2 of the weak link, as described hereinbefore, and the release bolts 11 break the piston rod 105 will be pulled outward from the cylinder 100. The rod 105 will pull the piston 104 along with it. FIG. 13*a* shows a cross section similar to FIG. 12*a*, but where the piston 104 and piston rod 105 have been pulled somewhat outward. Due to the pulling force, hydraulic fluid within the cylinder will be forced out of the cylinder through the bore 115 in the rod 105. Initially, fluid will also be forced out via the circumferential groove 117. As the first part 108*a* of the groove 108 travels through the end cap 103, fluid will also flow along this groove to the outside. The first groove part 108*a* is relatively deep and thus the travelling speed of the piston rod 105 will be relatively high as long as the first groove part 108*a* allows flow through the end cap 103.

FIGS. 13*a, c* and *d* shows the situation when the inner end of the groove part 108*a* reaches the end cap 103.

When the whole of the groove part 108*a* has penetrated through the end cap 103, the fluid will flow along the second and shallower groove part 108*b*. This will reduce the travelling speed of the piston rod 105.

When the whole of the second groove part 108*b* has penetrated through the end cap 103, the third and shallowest groove part 108*c* has been reached. This will slow down the travelling speed of the piston rod even more.

Only when the shallowest groove part 108*c* has penetrated the end cap 103, the last and deeper groove part 108*d* is reached. Then the traveling speed of the piston rod is increased again to ensure separation of the piston rod 105 and the piston 104, as will be explained below.

Figure 14A:
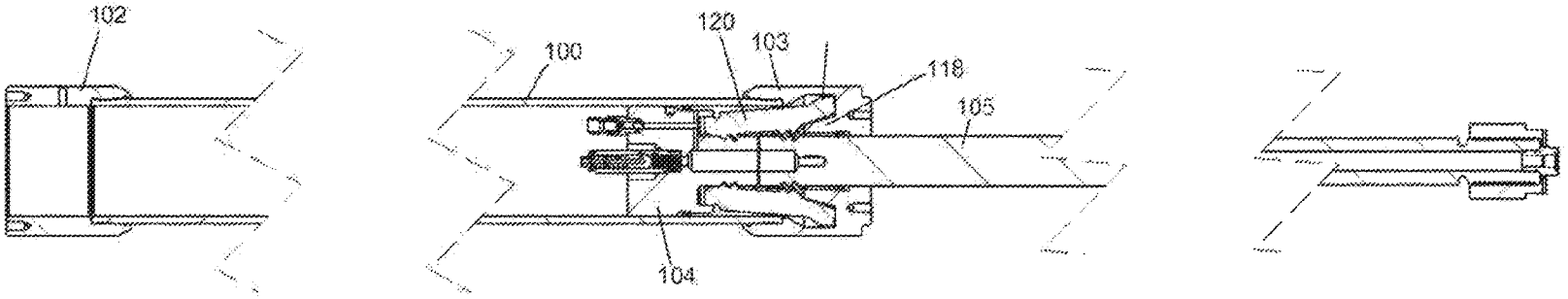
FIG. 14*a* shows a longitudinal section of the damper in a fully extended position.
Figure 14B:
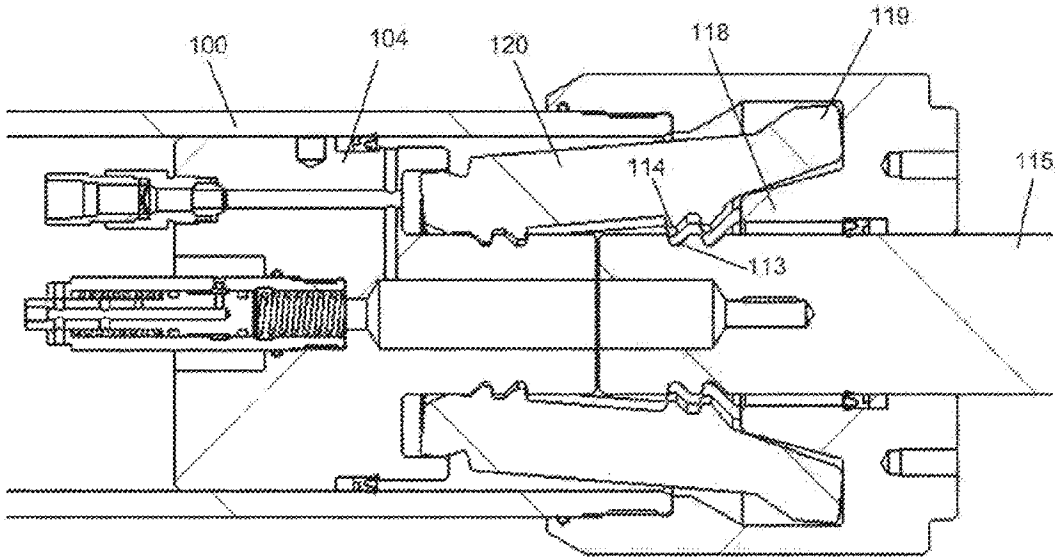
FIG. 14*b* shows a longitudinal section of a second end of the damper in a fully extended position.
Figure 14C:
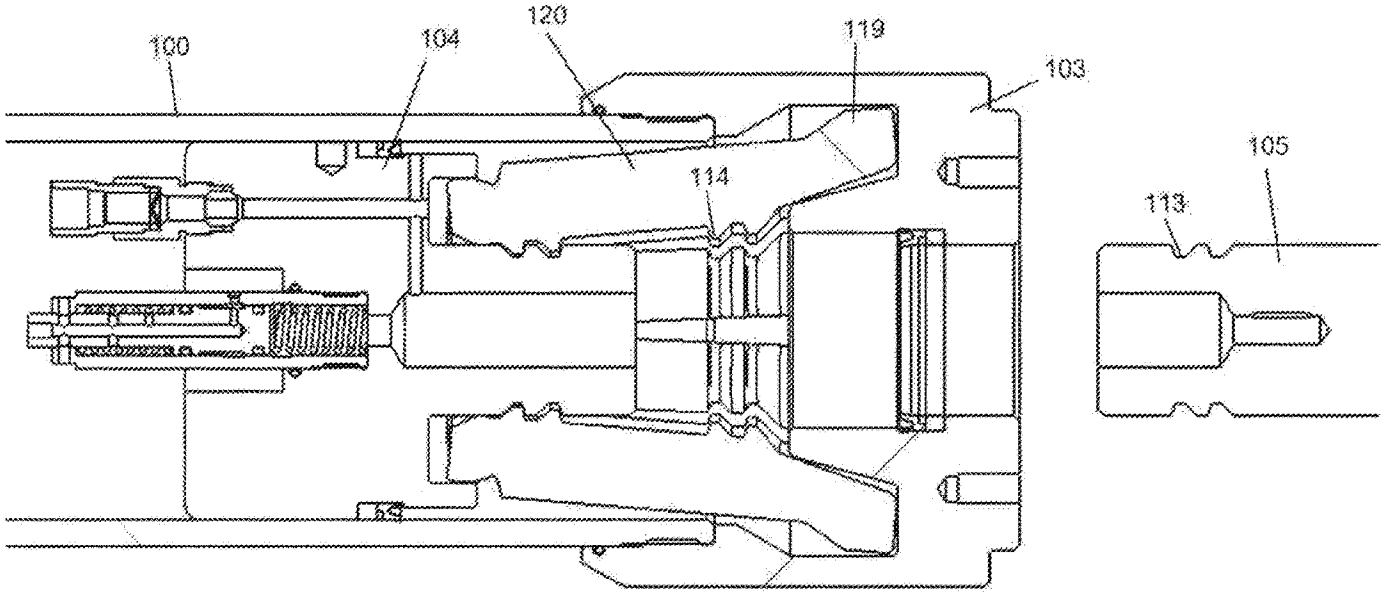
FIG. 14*c* shows a longitudinal section of a second end of the damper in a disconnected state.

Referring to FIGS. 14*a* and *b*: when the piston 104 reaches the outer end of the cylinder 100, the dogs 120 will meet the ring shaped projection 118. The ring shaped projection 118 will enter into the conical cavity 121 and force the distal end 119 of the dogs 120 outward. The end cap 103 has a larger inner diameter than the cylinder 100, allowing the distal ends 119 of the dogs to move outward and thereby release their grip in the piston rod 105. FIG. 14*c* shows the piston rod 105 being completely separated from the piston 104.

The release of hydraulic fluid from the cylinder 100 can be done in a controlled manner by adapting the width and depth of the groove 108 and the channel 117 to achieve the desired separation rate.

The present invention has been described with reference to preferred embodiments and some drawings for the sake of understanding only and it should be clear to persons skilled in the art that the present invention includes all legitimate modifications within the ambit of what has been described hereinbefore and claimed in the appended claims. It would be readily understood that the pin can be attached to the upper part of the riser and the box to the lower part or seabed equipment without deviating from the invention.

The invention claimed is:

1. A weak link for a riser system, the weak link comprising:
a first member;
a second member;
wherein each of the first member and the second member comprises a bore communicating with a bore of a riser;
a connection means for releasably connecting the first member and the second member, the connection means being designed to break at a predefined tension;
wherein a pressure balancing mechanism is provided for balancing axial forces acting on the connection means due to end cap effect of the riser system;
wherein the pressure balancing mechanism comprises a first pressure balance piston for transferring pressure load to a box of the second member and a second pressure balance piston for transferring pressure load to a pin of the first member; and
wherein the first and second balancing pistons are situated, when the pin and the box are in a fully connected state, at a mutual distance between the first and second balancing pistons that is greater than the diameter of the bores of the first member and the second member.

2. The weak link according to claim 1, wherein the pin and the box are releasably interconnected by release bolts.

3. The weak link according to claim 1, wherein the first pressure balancing piston and the second pressure balancing pistons are located in an annulus between the pin and the box, the annulus being in pressure communication with a bore of the pin, the pressure loads acting in opposite directions on the first pressure balancing piston and the second pressure balancing piston.

4. The weak link according to claim 3, wherein a radially moveable load transfer segment is located in connection with the first pressure balance piston for transferring the load from the first pressure balance piston to the box and that the second pressure balance piston is connected to the pin for transferring the load from the second pressure balance piston to the pin.

5. The weak link according to claim 4, wherein a recess is formed in the pin, the recess being situated, when the pin and the box are in a fully connected state, at a distance from the second balance piston, the recess, when the pin and the box are in a partially disconnected state, allowing the radially moveable load transfer segment to move into the recess and out of engagement with the box.

6. The weak link according to claim 1, wherein it comprises a stinger that is fixed at a first end to the box and has a second end extending into the bore of the pin in order to maintain a seal between the pin and the box during the separation stroke, the stinger providing a narrow annulus with the pin, which in turn provides communication between the bore of the pin and an annulus between the pin and the box.

7. The weak link according to claim 1, wherein the box comprises an aperture providing communication between the surrounding seawater and a void on the opposite side of the second pressure balance piston from the annulus between the pin and the box.

8. The weak link according to claim 6, wherein the pin comprises apertures providing communication between the bore of the pin and the annulus.

9. The weak link according to claim 8, wherein the box comprises an aperture extending to the surrounding seawater, the aperture being adapted to communicate with at least one of the apertures in the pin when the pin has moved partially out of the box, so as to bleed off pressure within the riser to the surrounding seawater.

10. The weak link according to claim 1, wherein it comprises a damping mechanism for damping any sudden recoiling effect between the first member and the second member during their separation.

11. The weak link according to claim 10, wherein the damping mechanism comprises one or more cylinders and piston arrangements, the damping mechanism being connected to the box by one of the cylinder or the piston arrangement and the other of the cylinder and the piston arrangement being connected to the pin.

12. The weak link according to claim 10, wherein the damping mechanism has at least one small aperture arranged to slowly expel fluid contained inside the damping mechanism through the aperture, for damped separation of the box and the pin.

13. The weak link according to claim 12, wherein the small aperture at least partly is formed by a groove in a piston rod, the piston rod being connected a piston inside a cylinder of the damping mechanism.

14. The weak link according to claim 13, wherein the piston is connected to the piston rod by a releasable mechanism.

15. The weak link according to claim 14, wherein the releasable mechanism comprises a plurality of dogs that grip the piston and the piston rod by mating grooves and projections and a projection at the distal end of the cylinder is adapted to push the plurality of dogs radially and out of interference with the piston rod.

16. The weak link according to claim 10, wherein the damping mechanism is an integral part of the pressure balancing mechanism.

17. The weak link according to claim 4, wherein at least one groove is located on the pin which groove in the event of separation of the box from the pin, provides space to receive the load transfer segment so as to bring the segment out of engagement with the box, thereby allowing complete separation of the pin and box.

18. The weak link according to claim 1, wherein it comprises a strong mode means adapted to selectively increase the gripping force between the second member and the first member.

19. The weak link according to claim 18, wherein the strong mode means comprises a strong mode activation dynamic piston operatively coupled to a strong mode locking ring.

20. The weak link according to claim 19, wherein the strong mode means comprises a first hydraulic fluid pressure conduit that is adapted to deliver hydraulic pressure to a first chamber for displacing the dynamic piston in a first direction and displace the strong mode locking ring radially into a groove in the box.

21. The weak link according to claim 20, wherein the strong mode means further comprises a strong mode static piston situated on the axially opposite side of the strong mode locking ring relative to the dynamic piston.

22. The weak link according to claim 21, wherein the strong mode means comprises a hydraulic second conduit adapted to deliver hydraulic pressure to a second chamber opposite of the first chamber relative to the dynamic piston for displacing the dynamic piston in a second direction opposite to the first direction and displace the strong mode locking ring radially out of the groove in the box.

23. The weak link according to claim 4, wherein the second pressure balance piston is connected to the pin by a threaded connection.

* * * * *